US007556668B2

(12) United States Patent
Eason et al.

(10) Patent No.: US 7,556,668 B2
(45) Date of Patent: Jul. 7, 2009

(54) CONSOLIDATED HARD MATERIALS, METHODS OF MANUFACTURE, AND APPLICATIONS

(75) Inventors: Jimmy W. Eason, The Woodlands, TX (US); James C. Westhoff, The Woodlands, TX (US); Roy Carl Lueth, St. Clair, MI (US)

(73) Assignee: Baker Hughes Incorporated, Houston, TX (US)

( * ) Notice: Subject to any disclaimer, the term of this patent is extended or adjusted under 35 U.S.C. 154(b) by 443 days.

(21) Appl. No.: 10/496,246

(22) PCT Filed: Dec. 4, 2002

(86) PCT No.: PCT/US02/38664

§ 371 (c)(1),
(2), (4) Date: May 20, 2004

(87) PCT Pub. No.: WO03/049889

PCT Pub. Date: Jun. 19, 2003

(65) Prior Publication Data

US 2005/0117984 A1 Jun. 2, 2005

Related U.S. Application Data

(60) Provisional application No. 60/336,835, filed on Dec. 5, 2001.

(51) Int. Cl.
*B22F 3/12* (2006.01)

(52) U.S. Cl. ..... 75/236; 75/238; 75/240; 75/246; 75/247; 75/249; 419/12; 419/14; 419/38; 419/48; 419/49; 175/426

(58) Field of Classification Search ..... 75/236, 75/238, 245, 246, 247, 249; 419/12, 14, 419/38, 48, 49

See application file for complete search history.

(56) References Cited

U.S. PATENT DOCUMENTS

| | | | | |
|---|---|---|---|---|
| 3,149,411 | A | 9/1964 | Smiley et al. | |
| 3,322,513 | A | 5/1967 | Corbett | |
| 3,383,208 | A | 5/1968 | Corral | |
| 3,384,465 | A | 5/1968 | Humenik, Jr. et al. | |
| 3,469,976 | A | 9/1969 | Iler | |
| 3,698,878 | A | 10/1972 | Hale | |
| 3,785,801 | A * | 1/1974 | Benjamin | 75/255 |
| 3,811,961 | A | 5/1974 | Weinstein et al. | |
| 3,916,497 | A | 11/1975 | Doi et al. | |
| 4,094,709 | A | 6/1978 | Rozmus | |
| 4,108,652 | A | 8/1978 | Ogawa et al. | |
| 4,233,720 | A | 11/1980 | Rozmus | |
| 4,341,557 | A | 7/1982 | Lizenby | |
| 4,353,714 | A | 10/1982 | Lee et al. | |
| 4,400,213 | A | 8/1983 | Sheinberg | |
| 4,428,906 | A | 1/1984 | Rozmus | |
| 4,455,278 | A | 6/1984 | van Nedervenn et al. | |
| 4,499,048 | A | 2/1985 | Hanejko | |
| 4,526,748 | A | 7/1985 | Rozmus | |
| 4,537,097 | A | 8/1985 | Illerhaus et al. | |
| 4,547,337 | A | 10/1985 | Rozmus | |
| 4,554,130 | A | 11/1985 | Ecer | |
| 4,556,424 | A | 12/1985 | Viswanadham | |
| 4,562,990 | A | 1/1986 | Rose | |
| 4,596,694 | A | 6/1986 | Rozmus | |
| 4,597,730 | A | 7/1986 | Rozmus | |
| 4,599,215 | A | 7/1986 | Smarsly et al. | |
| 4,609,526 | A | 9/1986 | Haswell et al. | |
| 4,630,692 | A | 12/1986 | Ecer | |
| 4,656,002 | A | 4/1987 | Lizenby et al. | |
| 4,684,405 | A | 8/1987 | Kolaska et al. | |
| 4,724,123 | A | 2/1988 | Rozmus, Jr. | |
| 4,744,943 | A | 5/1988 | Timm | |
| 4,808,224 | A | 2/1989 | Anderson et al. | |
| 4,853,298 | A | 8/1989 | Harner et al. | |
| 4,856,311 | A | 8/1989 | Conaway | |
| 4,911,756 | A | 3/1990 | Nakai et al. | |
| 4,923,512 | A | 5/1990 | Timm et al. | |
| 4,973,356 | A | 11/1990 | von Holst et al. | |
| 5,015,290 | A | 5/1991 | Tiegs et al. | |
| 5,032,352 | A | 7/1991 | Meeks et al. | |
| 5,111,895 | A | 5/1992 | Griffin | |
| 5,151,247 | A | 9/1992 | Haglund et al. | |
| 5,223,020 | A | 6/1993 | Kolaska | |
| 5,232,522 | A | 8/1993 | Doktycz et al. | |

(Continued)

FOREIGN PATENT DOCUMENTS

| | | | |
|---|---|---|---|
| DE | 19711642 | A1 | 9/1998 |

(Continued)

OTHER PUBLICATIONS

Alloy Digest Data on world wide metals and Alloys, SEALVAR(R), Jan. 1999.*

(Continued)

*Primary Examiner*—Roy King
*Assistant Examiner*—Ngoclan T Mai
(74) *Attorney, Agent, or Firm*—TraskBritt

(57) ABSTRACT

The present invention includes consolidated hard materials, methods for producing them, and industrial drilling and cutting applications for them. A consolidated hard material may be produced using hard particles such as $B_4C$ or carbides or borides of W, Ti, Mo, Nb, V, Hf, Ta, Zr, and Cr in combination with an iron-based, nickel-based, nickel and iron-based, iron and cobalt-based, aluminum-based, copper-based, magnesium-based, or titanium-based alloy for the binder material. Commercially pure elements such as aluminum, copper, magnesium, titanium, iron, or nickel may also be used for the binder material. The mixture of the hard particles and the binder material may be consolidated at a temperature below the liquidus temperature of the binder material using a technique such as rapid omnidirectional compaction (ROC), the CERACON™ process, or hot ecstatic pressing (HIP). After sintering, the consolidated hard material may be treated to alter its material properties.

35 Claims, 15 Drawing Sheets

U.S. PATENT DOCUMENTS

| | | | | |
|---|---|---|---|---|
| 5,348,694 | A | 9/1994 | Goldberger | |
| 5,445,788 | A | 8/1995 | Turenne et al. | |
| 5,570,750 | A | 11/1996 | Williams | |
| 5,593,474 | A | 1/1997 | Keshavan et al. | |
| 5,645,617 | A | 7/1997 | Frushour | |
| 5,678,166 | A | 10/1997 | Piehler et al. | |
| 5,765,095 | A | 6/1998 | Flak et al. | |
| 5,880,382 | A | 3/1999 | Fang et al. | |
| 6,022,175 | A | 2/2000 | Heinrich et al. | |
| 6,024,776 | A | 2/2000 | Heinrich et al. | |
| 6,202,770 | B1 * | 3/2001 | Jurewicz et al. | 175/428 |
| 6,248,150 | B1 | 6/2001 | Amick | |
| 6,368,377 | B1 | 4/2002 | Bryant et al. | |
| 6,402,802 | B1 | 6/2002 | Bhagat | |
| 6,451,442 | B1 | 9/2002 | Sue et al. | |
| 2003/0024350 | A1 * | 2/2003 | Majagi et al. | 75/240 |

FOREIGN PATENT DOCUMENTS

| | | | |
|---|---|---|---|
| EP | 0046209 | B1 | 9/1986 |
| EP | 0085125 | B1 | 9/1986 |
| EP | 0365506 | A2 | 4/1990 |
| GB | 1213371 | A | 11/1970 |
| GB | 1437069 | A | 5/1976 |
| GB | 1572524 | A | 7/1980 |

OTHER PUBLICATIONS

Moskowitz, D., "Abrasion Resistant Iron-Nickel Bonded Tungsten Carbide," Modern Dev. in Powder Met., 1976, pp. 543-551, vol. 10.

Moskowitz et al., "High-Strength Tungsten Carbides," International Journal of Powder Metallurgy, 1970, pp. 55-64.

Rivlin, V. G., 13: Critical evaluation of constitution of ternary systems C—Fe—X (X=Co, Ni, Cu), International Metals Reviews, 1984, pp. 96-121, vol. 29, No. 2.

Ikegaya et al., "Microstructure and Mechanical Properties of Functionally Graded Cemented Carbide, Sinter—Bonded on Steel," 14$^{th}$ International Plansee Seminar, May 12-16, 1997, 14 pages.

Prakash et al., "WC cemented carbides with improved binder alloys," Toward: Improved Performance of Tool Materials (HTC book), The Metals Society (London) 1981-1982 Conference, pp. 118-121.

PCT International Search Report dated Sep. 17, 2003.

Supplemental European Search Report mailed Mar. 1, 2006, for European counterpart Application No. 02802578.

"Table 1: Approximate Hardness Conversion Numbers for Non-Austenitic Steels (Rockwell C Hardness Range)" ASTM:E140-07, May 28, 2008, 1 page.

"Hardness Conversion Chart," Carbide Depot, <<www.carbidedepot.com/formulas-hardness.htm>> May 28, 2008, 3 pages.

European Search Report for European counterpart application No. 08009908.8, mailed Oct. 28, 2008.

* cited by examiner

CONSOLIDATED HARD MATERIALS, METHODS OF MANUFACTURE, AND APPLICATIONS

CROSS-REFERENCE TO RELATED APPLICATIONS

This application claims the benefit of U.S. provisional patent application Ser. No. 60/336,835 filed on Dec. 5, 2001, the disclosure of which is hereby incorporated herein by reference.

TECHNICAL FIELD

The present invention relates to hard materials and methods of production thereof. More particularly, the present invention relates to consolidated hard materials such as cemented carbide materials which may be manufactured by a subliquidus sintering process and exhibit beneficial metallurgical, chemical, magnetic, mechanical, and thermo-mechanical characteristics.

BACKGROUND ART

Liquid phase sintered cemented carbide materials, such as tungsten carbide using a cobalt binder (WC—Co), are well known for their high hardness and wear and erosion resistance. These properties have made it a material of choice for mining, drilling, and other industrial applications that require strong and wear resistant materials. Cemented tungsten carbide's properties have made it the dominant material used as cutting inserts and insert compacts in rock (tri-cone) bits and as substrate bodies for other types of cutters, such as superabrasive (generally polycrystalline diamond compact, or "PDC") shear-type cutters employed for subterranean drilling as well as for machining and other industrial purposes. However, conventional liquid phase sintered carbide materials such as cemented tungsten carbide also exhibit undesirably low toughness and ductility.

Conventional fabrication of cemented tungsten carbide is effected by way of a liquid phase sintering process. To elaborate, tungsten carbide powder is typically mixed with cobalt powder binder material and fugitive binder such as paraffin wax, and formed into a desired shape. This shaped material is then subsequently heated to a temperature sufficient to remove the fugitive binder and then further heated to a temperature sufficient to melt the cobalt and effectively "sinter" the material. The resulting components may also be subjected to pressure, either during or after the sintering operation to achieve full densification. The sintered material comprises tungsten carbide particulates surrounded by a solidified cobalt phase.

As alluded to above, in conventional liquid phase sintered tungsten carbide materials, as with many materials, fracture toughness is generally inversely proportional to hardness, while wear resistance is generally directly proportional to hardness. Although improvements in the fracture toughness of cemented tungsten carbide materials have been made over time, this parameter is still a limiting factor in many industrial applications where the cemented tungsten carbide structures are subjected to high loads during use. The material properties of cemented tungsten carbide can be adjusted to a certain degree by controlling the amount of cobalt binder, the carbon content, and the tungsten carbide grain size distribution. However, the bulk of the advancements using these conventional metallurgical techniques have largely been realized. U.S. Pat. No. 5,880,382 to Fang et al. attempts to solve some of the limitations of conventional WC—Co materials but uses expensive double cemented carbides.

Another drawback to conventional cemented-tungsten carbide materials is the limitation of using cobalt as the binder. About forty-five percent of the world's primary cobalt production is located in politically unstable regions, rendering supplies unreliable and requiring manufacturers to stockpile the material against potential shortfalls. Also, about fifteen percent of the world's annual primary cobalt market is used in the manufacture of cemented tungsten carbide materials. A large percentage of the cobalt supply is used in the production of superalloys used in aircraft engines, a relatively price-insensitive application which maintains fairly robust levels of cobalt prices. These factors contribute to the high cost of cobalt and its erratic price fluctuations.

Cobalt has also been implicated as a contributor to heat checking when used as inserts in rolling cutter bits as well as in tungsten carbide substrates for cutters or cutting elements using superabrasive tables, commonly termed polycrystalline diamond compact (PDC) cutters. Heat checking, or thermal fatigue, is a phenomenon where the cemented tungsten carbide in either application rubs a formation, usually resulting in significant wear, and the development of fractures on the worn surface. It is currently believed that thermal cycling caused by frictional heating of the cemented tungsten carbide as it comes in contact with the formation, combined with rapid cooling as the drilling fluid contacts the tungsten carbide, may cause or aggravate the tendency toward heat checking. The large difference in coefficient of thermal expansion (CTE) between the cobalt binder and the tungsten carbide phase is thought to substantially contribute to heat checking fracture. Another disadvantage of conventional WC—Co materials is that they are not heat treatable and cannot be surface case hardened in such a manner that is possible with many steels.

Non-cobalt-based binder materials such as iron-based and nickel-based alloys have long been sought as alternatives. U.S. Pat. No. 3,384,465 to Humenik, Jr. et al. and U.S. Pat. No. 4,556,424 to Viswanadham disclose such materials. However, problems due to the formation of undesirable brittle carbide phases developed during liquid phase sintering causing deleterious material properties, such as low fracture toughness, have deterred the use of iron-based and some nickel-based binders. Therefore, it would be desirable to produce a carbide material whose cementing phase exhibits, to at least a substantial degree or extent, the original mechanical characteristics (e.g., toughness, hardness, strength), thermo-mechanical characteristics (e.g., thermal conductivity, CTE), magnetic properties (e.g., ferromagnetism), chemical characteristics (e.g., corrosion resistance, oxidation resistance), or other characteristics exhibited by the binder material, in a macrostructural state. It is further desirable that the binder be heat treatable for improvement of strength and fracture toughness and to enable the tailoring of such properties. Further, the cemented carbide material should be capable of being surface case hardened, such as through carburizing or nitriding. In addition, the reduction or elimination of deleterious carbide phases within the cemented carbide material is desired. The present invention fulfills these and other long felt needs in the art.

DISCLOSURE OF INVENTION

The present invention includes consolidated hard materials, methods of manufacture, and various industrial applications in the form of such structures, which may be produced using subliquidus consolidation. A consolidated hard material according to the present invention may be produced using hard particles such as tungsten carbide and a binder material. The binder material may be selected from a variety of different aluminum-based, copper-based, magnesium-based, titanium-based, iron-based, nickel-based, iron and nickel-based, and iron and cobalt-based alloys. The binder may also be selected from commercially pure elements such as aluminum, copper, magnesium, titanium, iron, and nickel. Exemplary materials for the binder material may include carbon steels, alloy steels, stainless steels, tool steels, Hadfield manganese steels, nickel or cobalt superalloys, and low thermal expansion alloys. The binder material may be produced by mechanical alloying such as in an attritor mill or by conventional melt and atomization processing. The hard particles and the binder material may be mixed using an attritor or ball milling process. The mixture of the hard particles and binder material may be consolidated at a temperature below the liquidus temperature of the binder particles in order to prevent the formation of undesirable brittle carbides, such as the double metal carbides commonly known as eta phase. It is currently preferred that the consolidation be carried out under at least substantially isostatic pressure applied through a pressure transmission medium. Commercially available processes such as Rapid Omnidirectional Compaction (ROC), the CERACON™ process, or hot isostatic pressing (HIP) may be adapted for use in forming consolidated hard materials according to the present invention.

In an exemplary embodiment, at least one material characteristic of the binder, such as fracture toughness, strength, hardness, hardenability, wear resistance, thermo-mechanical characteristics (e.g., CTE, thermal conductivity), chemical characteristics (e.g., corrosion resistance, oxidation resistance), magnetic characteristics (e.g., ferromagnetism), among other material characteristics, may remain substantially the same before and after consolidation. Stated another way, binder material characteristics may not be significantly changed after the compacting or consolidation process. Stated yet another way, one or more binder material characteristics exhibited in a macrostructural or bulk state manifest themselves to at least a substantial extent in the consolidated hard material.

In another exemplary embodiment, the consolidation temperature may be between the liquidus and solidus temperature of the binder material.

In another exemplary embodiment, the consolidation temperature may be below the solidus temperature of the binder material.

In another exemplary embodiment, the binder material may be selected so that its coefficient of thermal expansion more closely matches that of the hard particles, at least over a range of temperatures.

In another exemplary embodiment, the subliquidus consolidated material may be surface hardened.

In another exemplary embodiment, the subliquidus consolidated material may be heat treated.

The present invention also includes using the consolidated hard materials of this invention to produce a number of different cutting and machine tools and components thereof such as, for example, inserts for percussion or hammer bits, inserts for rock bits, superabrasive shear cutters for rotary drag bits and machine tools, nozzles for rock bits and rotary drag bits, wear parts, shear cutters for machine tools, bearing and seal components, knives, hammers, etc.

BRIEF DESCRIPTION OF THE SEVERAL VIEWS OF THE DRAWINGS

In the drawings, which illustrate what is currently considered to be the best mode for carrying out the invention.

BEST MODES FOR CARRYING OUT THE INVENTION

Figure 1:
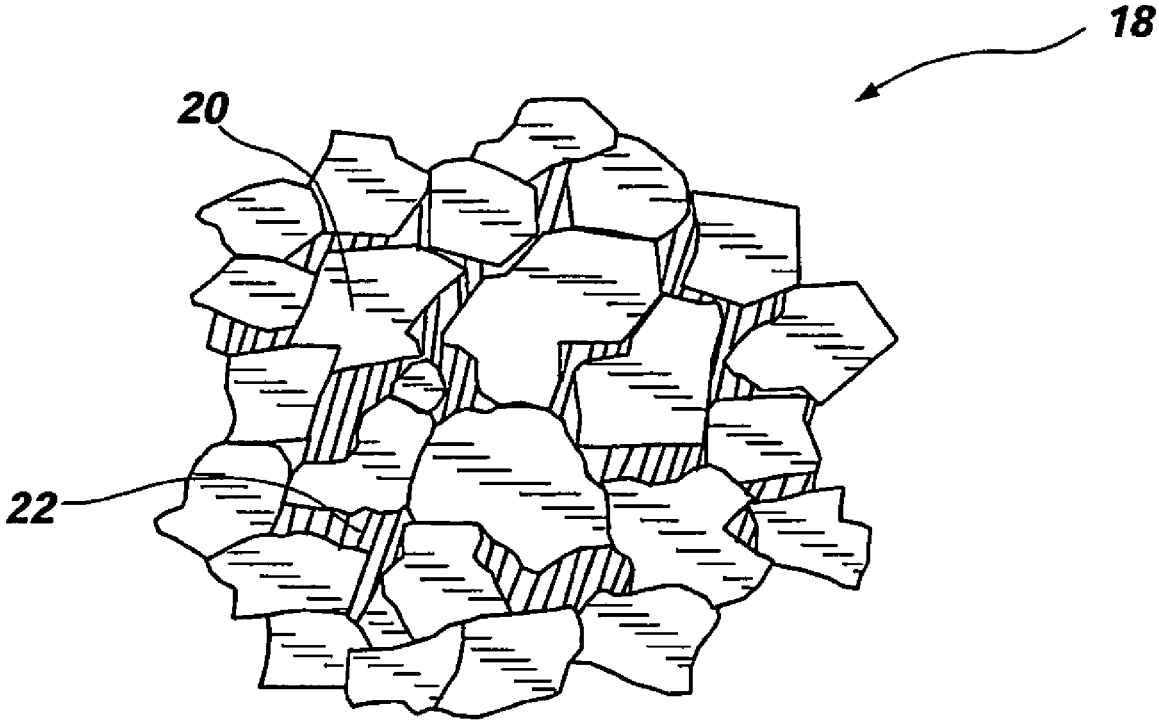
FIG. 1 is an exemplary microstructure of a cemented material.

Referring to FIG. 1, an exemplary microstructure of consolidated hard material 18 prepared according to the present invention is shown. FIG. 1 shows hard particles 20 bonded by binder material 22. In another exemplary embodiment for consolidated hard material 18, substantially all of hard particles 20 may be surrounded by a continuous binder material 22.

Exemplary materials for hard particles 20 are carbides, borides including boron carbide ($B_4C$), nitrides and oxides. More specific exemplary materials for hard particles 20 are carbides and borides made from elements such as W, Ti, Mo, Nb, V, Hf, Ta, Cr, Zr, Al, and Si. Yet more specific examples of exemplary materials used for hard particles 20 are tungsten carbide (WC), titanium carbide (TiC), tantalum carbide (TaC), titanium diboride ($TiB_2$), chromium carbides, titanium nitride (TiN), aluminum oxide ($Al_2O_3$), aluminum nitride (AlN), and silicon carbide (SiC). Further, combinations of different hard particles 20 may be used to tailor the material properties of a consolidated hard material 18. Hard particles 20 may be formed using techniques known to those of ordinary skill in the art. Most suitable materials for hard particles 20 are commercially available and the formation of the remainder is within the ability of one of ordinary skill in the art.

In one exemplary embodiment of the present invention, consolidated hard material 18 may be made from approximately 75 weight percent (wt %) hard particles 20 and approximately 25 wt % binder material 22. In another exemplary embodiment, binder material 22 may be between 5 wt % to 50 wt % of consolidated hard material 18. The precise proportions of hard particles 20 and binder material 22 will vary depending on the desired material characteristics for the resulting consolidated hard material.

Binder material 22 of consolidated hard material 18 of the present invention may be selected from a variety of iron-based, nickel-based, iron and nickel-based, iron and cobalt-based, aluminum-based, copper-based, magnesium-based, and titanium-based alloys. The binder may also be selected from commercially pure elements such as aluminum, copper, magnesium, titanium, iron, and nickel. Exemplary materials for binder material 22 may be heat treatable, exhibit a high fracture toughness and high wear resistance, may be compatible with hard particles 20, have a relatively low coefficient of thermal expansion, and may be capable of being surface hardened, among other characteristics. Exemplary alloys, by way of example only, are carbon steels, alloy steels, stainless steels, tool steels, Hadfield manganese steels, nickel or cobalt superalloys and low expansion iron or nickel-based alloys such as INVAR®. As used herein, the term "superalloy" refers to an iron, nickel, or cobalt-based alloy that has at least 12% chromium by weight. Further, more specific, examples of exemplary alloys used for binder material 22 include austenitic steels, nickel-based superalloys such as INCONEL® 625M or Rene 95, and INVAR® type alloys with a coefficient of thermal expansion of about $4\times10^{-6}$, closely matching that of a hard particle material such as WC. More closely matching the coefficient of thermal expansion of binder material 22 with that of hard particles 20 offers advantages such as reducing residual stresses and thermal fatigue problems. Another exemplary material for binder material 22 is a Hadfield austenitic manganese steel (Fe with approximately 12 wt % Mn and 1.1 wt % C) because of its beneficial air hardening and work hardening characteristics.

Subliquidus consolidated materials according to the present invention may be prepared by using adaptations of a number of different methods known to one of ordinary skill in the art, such as a Rapid Omnidirectional Compaction (ROC) process, the CERACON™ process, or hot isostatic pressing (HIP).

Broadly, and by way of example only, processing materials using the ROC process involves forming a mixture of hard particles and binder material, along with a fugitive binder to permit formation by pressing of a structural shape from the hard particles and binder material. The mixture is pressed in a die to a desired "green" structural shape. The resulting green insert is dewaxed and presintered at a relatively low temperature. The presintering is conducted to only a sufficient degree to develop sufficient strength to permit handling of the insert. The resulting "brown" insert is then wrapped in a material such as graphite foil to seal the brown insert. It is then placed in a container made of a high temperature, self-sealing material. The container is filled with glass particles and the brown parts wrapped in the graphite foil are embedded within the glass particles. The glass has a substantially lower melting temperature than that of the brown part or the die. Materials other than glass and having the requisite lower melting temperature may also be used as the pressure transmission medium. The container is heated to the desired consolidation temperature, which is above the melting temperature of the glass. The heated container with the molten glass and the brown parts immersed inside is placed in a mechanical or hydraulic press, such as a forging press, that can apply sufficient loads to generate isostatic pressures to fully consolidate the brown part. The molten glass acts to transmit the load applied by the press uniformly to the brown insert and helps protect the brown insert from the outside environment. Subsequent to the release of pressure and cooling, the consolidated part is then removed from the glass. A more detailed explanation of the ROC process and suitable apparatus for the practice thereof is provided by U.S. Pat. Nos. 4,094,709, 4,233,720, 4,341,557, 4,526,748, 4,547,337, 4,562,990, 4,596,694, 4,597,730, 4,656,002 4,744,943 and 5,232,522.

The CERACON™ process, which is similar to the aforementioned ROC process, may also be adapted for use in the present invention to fully consolidate the brown part. In the CERACON™ process, the brown part is coated with a ceramic coating such as alumina, zirconium oxide, or chrome oxide. Other similar, hard, generally inert protectively removable coatings may also be used. The coated brown part is fully consolidated by transmitting at least substantially isostatic pressure to the coated brown part using ceramic particles instead of a fluid media as used in the ROC process. A more detailed explanation of the CERACON™ process is provided by U.S. Pat. No. 4,499,048.

The process for making the precursor materials for forming a consolidated hard material 18 of the present invention is described in more detail below.

Binder material 22 may be produced by way of mechanical alloying in an attritor or ball mill. Mechanical alloying is a process wherein powders are mixed together under a protective atmosphere of argon, nitrogen, helium, neon, krypton, xenon, carbon monoxide, carbon dioxide, hydrogen, methane, forming gas or other suitable gas within an attritor milling machine containing mixing bars and milling media such as carbide spheres. Nitrogen may not be suitable in all instances due to the potential for formation of nitrides. Such mechanical alloying is well known to one of ordinary skill in the art for other applications, but to the inventors' knowledge, has never been employed to create a non-cobalt binder alloy for cemented hard materials. Collisions between the bars and/or spheres and powder in the attritor mill cause the binder powder particles to fracture and/or be welded or smeared together. Large particles tend to fracture during the mechanical alloying process while smaller particles tend to weld together, resulting after time in a particulate binder material 22, generally converging to a particle size of about 1 μm. As the process continues, particles become increasingly comprised of a homogenous mixture of the constituent powders in the same proportion in which they were mixed.

To form the mechanically alloyed binder finely divided particles of iron-based alloys, nickel-based alloys, iron and nickel-based alloys and iron and cobalt-based alloys, and carbon in the form of lamp black or finely divided graphite particles may be disposed in the attritor mill and milling initiated until a desired degree of alloying is complete. It should be noted that complete alloying may be unnecessary, as a substantially mechanically alloyed composition may complete the alloying process during subsequent consolidation to form the material of the present invention.

Alternatively, binder material 22 may be alloyed by conventional melting processes and then atomized into a fine particulate state as is known to those of ordinary skill in the art. In yet another exemplary implementation, binder material 22 may become substantially mechanically alloyed, and then complete some portion of alloying during the sintering process.

In an exemplary embodiment, one or more material characteristics of binder material 22 such as fracture toughness, strength, hardness, hardenability, wear resistance, thermomechanical properties (e.g., CTE, thermal conductivity), chemical properties (e.g., corrosion resistance, oxidation resistance), and magnetic properties (e.g., ferromagnetism), among others, may be substantially unaffected upon consolidation with hard particles 20. In other words, binder material 22 substantially retains one or more material characteristics possessed or exhibited prior to consolidation when it is in its cemented state with hard particles 20. Stating the material characteristics exhibited by the consolidated hard material 18 another way, at least one material characteristic exhibited by binder material 22 in a macrostructural state, manifests itself in the consolidated hard material 18. The term "macrostructural" is used in accordance with its common meaning as "[t]he general arrangement of crystals in a sold metal (e.g., an ingot) as seen by the naked eye or at low magnification. The term is also applied to the general distribution of impurities in a mass of metal as seen by the naked eye after certain methods of etching," Chamber's Technical Dictionary, 3rd ed. New York, The Macmillan Company, 1961, p. 518.

Regardless of how the desired binder material 22 is manufactured, hard particles 20 are then combined with the binder material 22 in an attritor, ball, or other suitable type of mill in order to mix and at least partially mechanically coat hard particles 20 with binder material 22. Although some portion of hard particles 20 may be fractured by the attritor milling process, typically binder material 22 is dispersed and may at least be partially smeared and distributed onto the outside surface of hard particles 20. Hard particles 20, by way of example only, may typically be between less than 1 μm to 20 μm in size, but may be adjusted in size as desired to alter the final material properties of the consolidated hard material 18. In an integrated process according to the present invention, the hard particles 20 may be introduced into the same attritor mill in which the mechanically alloyed binder material has been formed, although this is not required and it is contemplated that binder material 22 may be formed and then removed from the attritor mill and stored for future use.

In any case, to the mixture of hard particles 20 and binder material 22, about 20% by volume of an organic compound, typically a paraffin wax is added in an attritor or ball mill, as well as a milling fluid comprising acetone, heptane, or other fluid that dissolves or disperses the paraffin wax, providing enough fluid to cover the hard particles 20 and binder material 22 and milling media. Mixing, or milling, of the hard particles 20 and binder material 22 is initiated and continues for the time required to substantially coat and intimately mix all of the hard particles 20 with the binder material 22.

Subsequent to the mixing operation, the milling fluid is then removed, typically by evaporation, leaving a portion of the paraffin wax on and around the mixture of binder material 22 and coated hard particles 20, although it is possible that uncoated hard particles 20 may remain. Free binder material particles may also remain in the mixture.

After the milling process of the desired amounts of hard particles 20 and binder material 22, a green part is formed into a desired shape by way of mechanical pressing or shaping. Techniques for forming the green parts are well known to those of ordinary skill in the art.

The green part is then dewaxed by way of vacuum or flowing hydrogen at an elevated temperature. Subsequent to dewaxing, the dewaxed green part is subjected to a partial sintering furnace cycle in order to develop sufficient handling strength. The now brown part is then wrapped in graphite foil, or otherwise enclosed in a suitable sealant or canning material. The wrapped, dewaxed brown part is then again heated and subjected to an isostatic pressure during a consolidation process in a medium such as molten glass to a temperature that is below the liquidus temperature of the phase diagram for the particular, selected binder material 22. It is subjected to elevated pressures, at the particular temperature sufficient to completely consolidate the material. Accordingly, such an exemplary embodiment of hard material 18 may be said to be subliquidus sintered. In accordance with the present invention, the consolidation temperature may be below the liquidus temperature of the binder material 22 and above the solidus temperature, or may be below both the liquidus and solidus temperatures of the binder material, as depicted on a phase diagram of the selected binder material 22. It is currently preferred that the sintering operation be conducted in an "incipient melting" temperature zone, where a small and substantially indeterminate portion of the binder material 22 may experience melting, but the binder material 22 as a whole remains in a solid state. Alternatively, sintering below the solidus temperature of the binder material 22 as depicted on the phase diagram may be used to practice the present invention.

By performing the consolidation process below the liquidus temperature of binder material 22, chemical alteration of the binder alloy may be minimized. Alterations of the binder are facilitated by the exposure of the binder in its liquid state to other materials where chemical reactions, diffusion, dissolution, and mixing are possible. Formation of undesirable brittle carbides in binder material 22, for example, may be prevented when the subliquidus consolidation process is employed and the liquid state is avoided. As is known to those skilled in the art, examples of these undesirable brittle phases, also known as double metal carbides are, $FeW_3C$, $Fe_3W_3C$, $Fe_6W_6C$, $Ni_2W_4C$, $CO_2W_4C$, $CO_3W_3C$, and $Co_6W_6C$, which may develop when elemental iron, nickel, or cobalt, or their alloys are used for binder material 22 and tungsten carbide is used for hard particles 20 in a conventional sintering process.

The heated, dewaxed brown part is subjected to isostatic pressure processing under the aforementioned protective medium. Pressure may be applied by surrounding the dewaxed brown part with glass particles, which melt upon further heating of the dewaxed brown part and surrounding glass particles to the aforementioned subliquidus temperature zone of the binder material 22 and enable the uniform (isostatic) application of pressure from a press to the brown part. Alternatively, graphite, salt, metal, or ceramic particles may be used to surround the dewaxed brown part, and force may be applied to the graphite to provide the pressure to the part. Sufficient pressures, typically in the range of 120 ksi, may be used to consolidate the brown part during the sintering process.

Subliquidus consolidation processing according to the present invention has many advantages for processing powder materials. Some of the benefits of subliquidus consolidation processing are lower temperature processing, shorter processing times, less expensive processing equipment than conventional HIP, and substantial retention of the binder material 22 characteristics upon consolidation, among other things.

The final consolidated hard material may, as is appropriate to the particular binder material, be heat treated, surface hardened or both to tailor material characteristics, such as fracture toughness, strength, hardness, hardenability, wear resistance, thermo-mechanical characteristics (e.g., CTE, thermal conductivity), chemical properties (e.g., corrosion resistance, oxidation resistance), magnetic characteristics (e.g., ferromagnetism), among other material characteristics, for particular applications. The resulting consolidated hard materials may be subjected to conventional finishing operations such as grinding, tumbling, or other processes known to those of ordinary skill in the art that are used with conventional WC—Co materials, making design and manufacture of finished products of the consolidated hard material of the present invention to substitute for conventional WC—Co products relatively easy.

After subliquidus consolidation, the consolidated hard material of the present invention may be subjected to post consolidation thermal, chemical, or mechanical treatments to modify its material properties or characteristics. As an example, subsequent, to subliquidus consolidation, the part may be heat treated, such as by traditional annealing, quenching, tempering, or aging, as widely practiced by those of ordinary skill in the art with respect to metals and alloys but not with respect to cemented carbides or similar consolidated materials, to alter the properties or characteristics of the material as significantly affected by the response of binder material used therein.

Exemplary surface treatments that also may be used to increase the hardness of the surface of a consolidated hard material of the present invention are carburizing, carbonitriding, nitriding, induction heating, flame hardening, laser surface hardening, plasma surface treatments, and ion implantation. Exemplary mechanical surface hardening methods include shot peening and tumbling. Other surface treatments will be apparent to one of ordinary skill in the art.

Figure 2A:
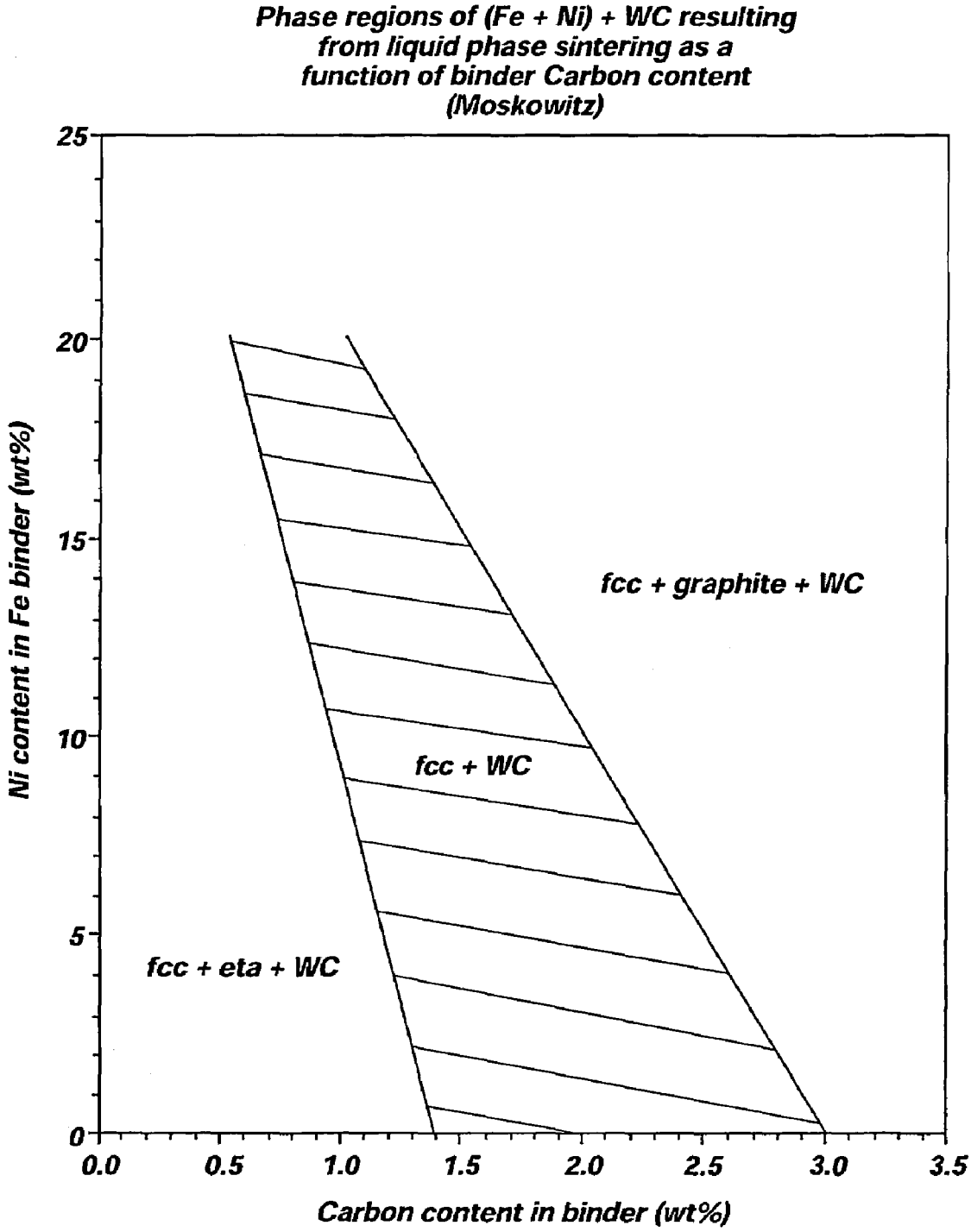
FIG. 2A is a phase diagram for a prior art Fe—Ni—WC carbide system resulting from liquid phase sintering as a function of carbon content in the binder material.
Figure 2B:
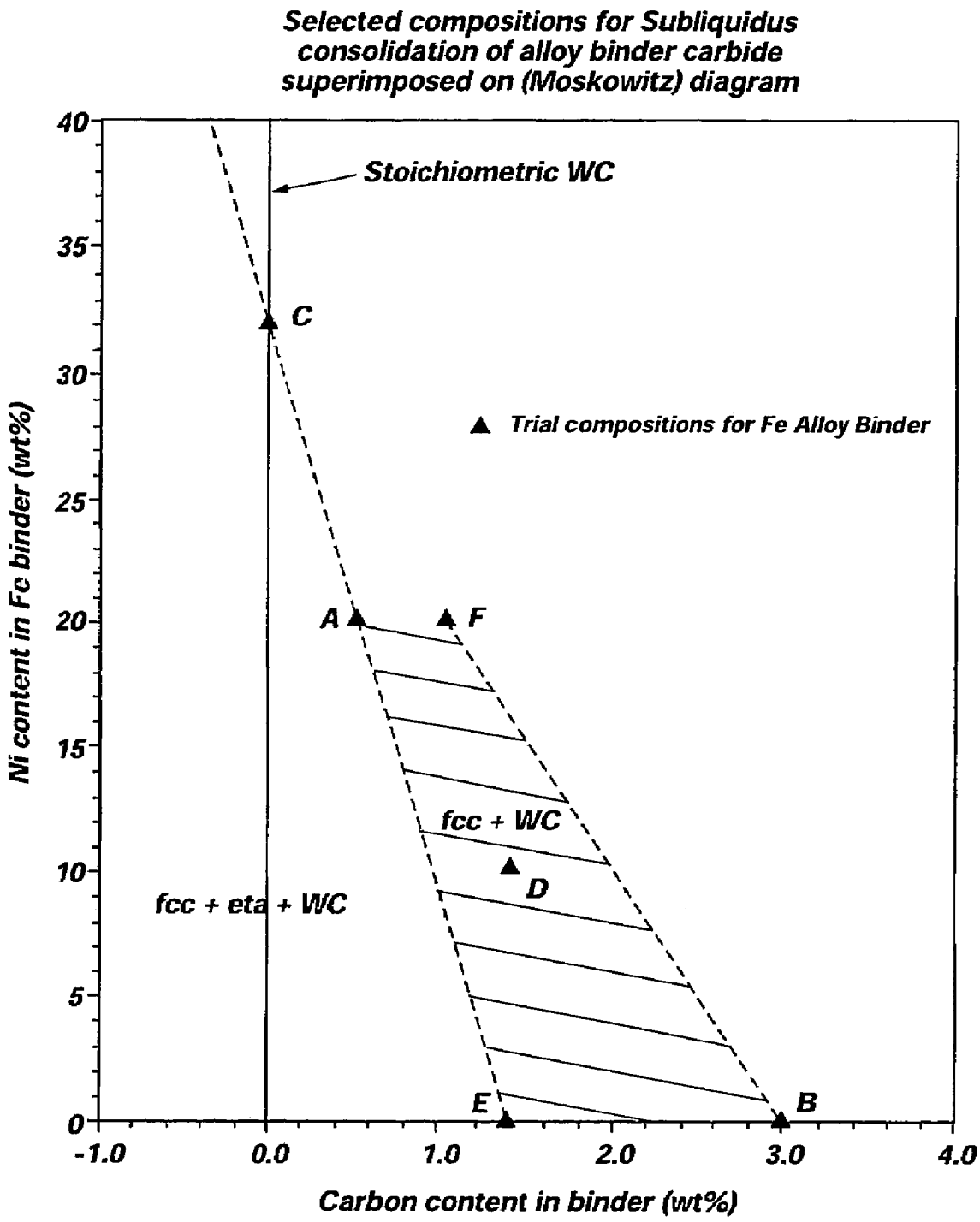
FIG. 2B is a phase diagram for subliquidus consolidation of alloy binder carbide according to the present invention superimposed on the diagram of FIG. 2A.

The consolidated hard materials of this invention will be better understood with reference to the following examples shown in Table I, FIG. 2B and the descriptions below. FIG. 2B is a phase diagram which includes Alloys A through F of Examples 1 through 6 below, indicated by appropriate letters respectively corresponding to the examples. Note that the region to the right of dashed line B-F in FIG. 2B does not contain graphite in the inventive process.

TABLE I

Exemplary Binder Material Compositions

| | Binder Composition (25 wt. % of the composite carbide material) | | | | | | Carbon content of the composite carbide material (Binder + WC) |
|---|---|---|---|---|---|---|---|
| Alloy | Fe | Ni | Cr | Nb | Mo | C | (wt %) |
| A | 79.6 | 19.9 | 0.0 | 0.0 | 0.0 | 0.5 | 4.72 |
| B | 97.0 | 0.0 | 0.0 | 0.0 | 0.0 | 3.0 | 5.35 |
| C | 68.0 | 32.0 | 0.0 | 0.0 | 0.0 | 0.0 | 4.60 |
| D | 88.7 | 9.9 | 0.0 | 0.0 | 0.0 | 1.4 | 4.95 |
| E | 98.6 | 0.0 | 0.0 | 0.0 | 0.0 | 1.4 | 4.95 |
| F | 79.2 | 19.8 | 0.0 | 0.0 | 0.0 | 1.0 | 4.85 |
| G | 5.0 | 60.5 | 20.5 | 5.0 | 9.0 | 0.0 | 4.60 |

EXAMPLE 1

Alloy A

Binder material 22 was prepared according to the above-described attritor milling process. Approximately 75 wt % hard particles 20 and 25 wt % binder material 22 was used. Binder material 22 was comprised of 79.6 wt % Fe-19.9 wt % Ni-0.5 wt % C. Binder material 22 was approximately 1 μm in particle size. The hard particles 20 were tungsten carbide (WC) approximately 6 μm to 7 μm in size. The mixture of hard particles 20 and binder material 22 was pressed into rectangular bars, dewaxed, and presintered at 500° C. in a methane atmosphere and then subjected to ROC at 1150° C. After ROC processing, the resulting subliquidus consolidated tungsten carbide material had an average Rockwell A hardness (HRa) of 80.4. By contrast, the same material processed conventionally by liquid phase sintering had an average HRa of 79.0. After austenitizing and oil quenching to room temperature, the ROC processed material had an average HRa of 79.9. Subsequent quenching from room temperature to liquid nitrogen temperature resulted in an average HRa of 84.2.

EXAMPLE 2

Alloy B

Binder material 22 was prepared according to the above attritor milling process. Approximately 75 wt % hard particles 20 and 25 wt % binder material 22 was used. Binder material 22 was comprised of 97.0 wt % Fe-3.0 wt % C. Binder material 22 was approximately 1 μm in particle size. The hard particles 20 were WC approximately 6 μm to 7 μm in size. The mixture of hard particles 20 and binder material 22 was pressed into rectangular bars, dewaxed, and presintered at 500° C. in a methane atmosphere and then different samples were separately subjected to ROC processing at 1050° C. and 1100° C. After ROC processing at 1050° C. the resulting subliquidus consolidated tungsten carbide material had an average HRa of 82.9. After ROC processing at 1100° C. the resulting subliquidus consolidated tungsten carbide material had an average HRa of 81.1. By contrast, the same material processed conventionally by liquid phase sintering had an average HRa of 76.0. After austenitizing and oil quenching the subliquidus consolidated tungsten carbide material to room temperature, following ROC processing at 1050° C., the resulting HRa was 85.0. After austenitizing and oil quenching the material to room temperature, following ROC processing at 1100° C., the resulting average HRa was 83.2.

EXAMPLE 3

Alloy C

Binder material 22 was prepared according to the above attritor milling process. Approximately 75 wt % hard particles 20 and 25 wt % binder material 22 was used. Binder material 22 was comprised of 68.0 wt % Fe-32.0 wt % Ni. Binder material 22 was approximately 1 μm in particle size. The hard particles 20 were WC approximately 6 μm to 7 μm in size. The mixture of hard particles 20 and binder material 22 was pressed into rectangular bars, dewaxed, and presintered at 500° C. in a methane atmosphere and then subjected to ROC processing at approximately 1225° C. After ROC processing the resulting subliquidus consolidated tungsten carbide material had an average HRa of 78.0. After reheating to approximately 900° C. and oil quenching the material, following ROC processing, to room temperature, the resulting average HRa was 77.3. Subsequent quenching of the material in liquid nitrogen following oil quenching, resulted in an average HRa of 77.8. A beneficial property of binder material 22 used in alloy C is that its coefficient of thermal expansion more closely matches that of the WC hard particles 20 than a traditional cobalt binder.

Figure 3:
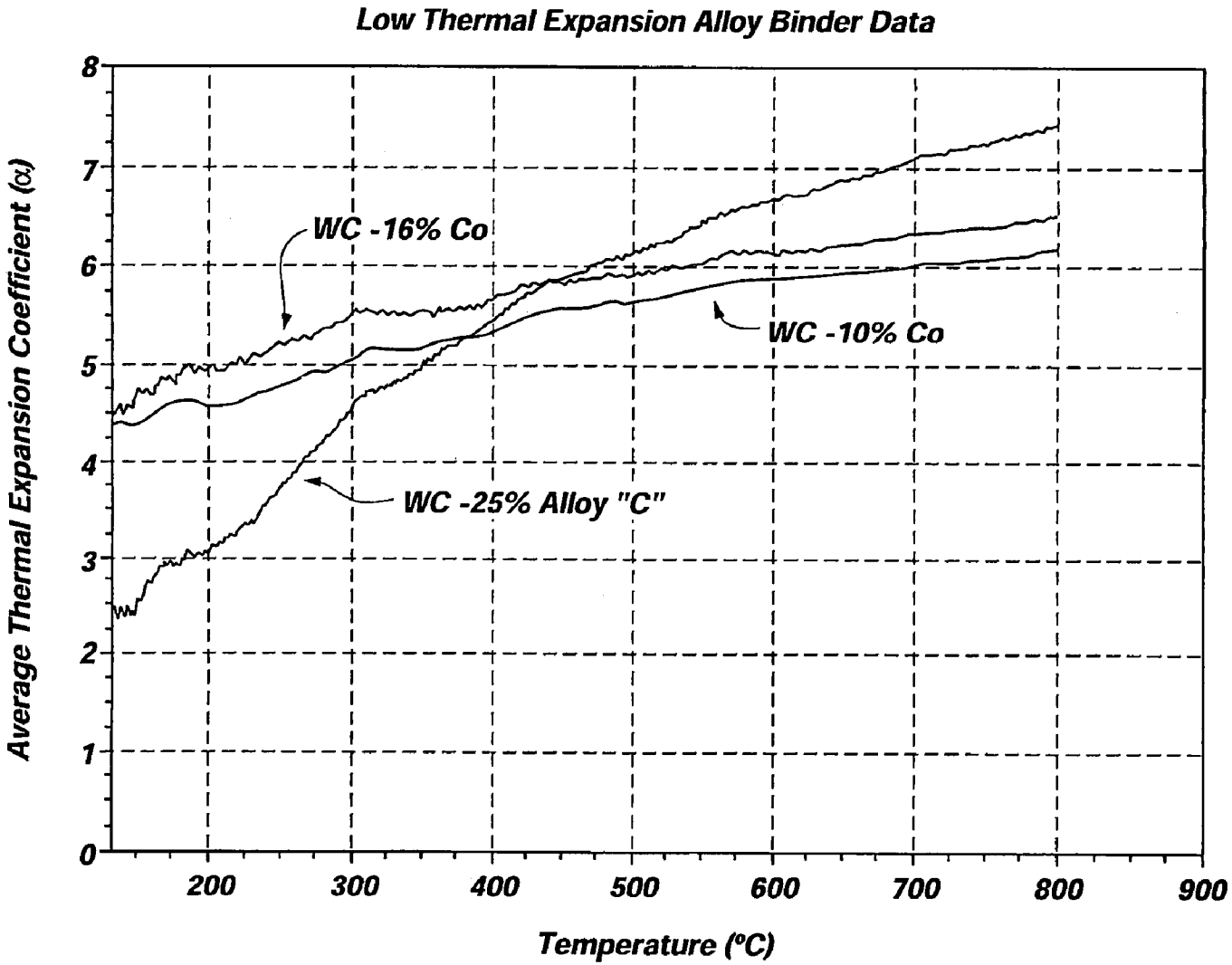
FIG. 3 is a graph of average thermal expansion coefficient of a carbide material of the present invention manufactured by subliquidus consolidation compared with conventionally processed cemented carbide materials.

Referring to FIG. 3, a graph of the average thermal expansion coefficient of a subliquidus consolidated carbide formulated with the low thermal expansion alloy C binder compared two different conventionally processed cemented carbide grades. The alloy C binder has as a similar composition to INVAR®, and the binder used in the conventionally processed cemented carbide binder is cobalt. It is evident that the subliquidus consolidated carbide containing binder alloy C has a lower coefficient of thermal expansion up to approximately 400° C. It should be noted that the binder content of this material is 25 wt % alloy C. The entire curve would be shifted toward lower values, at higher temperatures, as the total binder content was decreased, in accordance with the rule of mixtures for composite materials. Therefore, the coefficient of thermal expansion of subliquidus consolidated carbide may be adjusted or tailored by changes in the chemical composition of the alloy binder and by adjusting the total binder content. This feature of the present invention may be advantageous for designing materials more resistant to degradation due to thermal cycling than conventional cemented carbides.

EXAMPLE 4

Alloy D

Binder material 22 was prepared according to the above attritor milling process. Approximately 75 wt % hard particles 20 and 25 wt % binder material 22 was used. Binder material was comprised of 88.7 wt % Fe-9.9 wt % Ni-1.4 wt % C. Binder material 22 was approximately 1 μm in particle size. The hard particles 20 were WC approximately 6 μm to 7 μm in size. The mixture of hard particles 20 and binder material 22 was pressed into rectangular bars, dewaxed, and presintered at 500° C. in a methane atmosphere and then subjected to ROC processing at 1150° C. After ROC processing, the resulting subliquidus consolidated tungsten carbide material had an average HRa of 85.1. By contrast, the same material processed conventionally by liquid phase sintering had an average HRa of 83.8. After austenitizing and oil quenching to room temperature, the ROC processed material had an average HRa of 81.9. Subsequent quenching of this sample in liquid nitrogen resulted in an average HRa of 85.8.

EXAMPLE 5

Alloy E

Binder material 22 was prepared according to the above attritor milling process. Approximately 75 wt % hard particles 20 and 25 wt % binder material 22 was used. Binder material was comprised of 98.6 wt % Fe-1.4 wt % C. Binder material 22 was approximately 1 μm in particle size. The hard particles 20 were WC approximately 6 μm to 7 μm in size. The mixture of hard particles 20 and binder material 22 was pressed into rectangular bars, dewaxed, and presintered at 500° C. in a methane atmosphere and then samples were separately subjected to ROC processing at approximately 1050° C. and 1100° C. After ROC processing at 1050° C., the resulting subliquidus consolidated tungsten carbide material had an average HRa of 80.2. After ROC processing at 1100° C., the resulting subliquidus consolidated tungsten carbide material had an average HRa of 80.1. Subsequent austenitizing and oil quenching the material to room temperature, following ROC processing at 1050° C., resulted in an average HRa of 83.8. Subsequent austenitizing and oil quenching the material to room temperature, following ROC processing at 1100° C., resulted in an average HRa of 83.5. The same material processed conventionally by liquid phase sintering had an average HRa of 79.2.

EXAMPLE 6

Alloy F

Binder material 22 was prepared according to the above attritor milling process. Approximately 75 wt % hard particles 20 and 25 wt % binder material 22 was used. Binder material was comprised of 79.2 wt % Fe-19.8 wt % Ni-1.0 wt % C. Binder material 22 was approximately 1 μm in particle size. The hard particles 20 were WC approximately 6 μm to 7 μm in size. The mixture of hard particles 20 and binder material 22 was pressed into rectangular bars, dewaxed, and presintered at 500° C. in a methane atmosphere and then subjected to ROC processing at approximately 1150° C. After ROC processing, the resulting subliquidus consolidated tungsten carbide material had an average HRa of 80.6. After austenitizing and oil quenching a sample of the material to room temperature following ROC processing, the resulting average HRa was 80.2. After austenitizing, oil quenching to room temperature, then quenching to liquid nitrogen temperature, the average HRa of the sample was 84.3. By contrast, the same material processed conventionally by liquid phase sintering had an average HRa of 79.3.

EXAMPLE 7

Alloy G

Binder material 22 was prepared using a conventional melt/atomization process. Approximately 75 wt % hard particles 20 and 25 wt % binder material 22 was used. Binder material 22 was comprised of approximately of 60.5 wt % Ni, 20.5 wt % Cr, 5.0 wt % Fe, 9.0 wt % Mo, and 5.0 wt % Nb (approximately the same composition as INCONEL® 625M). Binder material 22 was approximately 25 μm in particle size. The hard particles 20 were WC approximately 6 μm to 7 μm in size. The powder mixture of hard particles 20 and binder material 22 was pressed into rectangular bars, dewaxed, and presintered at 500° C. in a methane atmosphere and then subjected to ROC processing at 1225° C. After ROC processing, the resulting subliquidus consolidated tungsten carbide material exhibited an average HRa of 83.8. After ROC processing, Knoop microhardness measurements were taken of the binder of the subliquidus consolidated carbide material resulting in an average value of 443, which corresponds to an average Rockwell "C" value of approximately 43. The published Rockwell "C" hardness value of fully heat treated INCONEL® 625M is approximately 40. By contrast, the average Knoop microhardness of the same binder after conventional liquid phase sintering was 1976, indicating that undesirable carbides may have formed. These compounds are most likely composed of the double metal carbides, as discussed previously. It may be observed that Alloy G comprises a superalloy, which is precipitation strengthened by a gamma" phase in a gamma matrix. A gamma phase is a face-centered cubic solid solution of a transition group metal from the periodic table. Typically, the transition metal may be cobalt, nickel, titanium or iron. The solute, or minor, element in the solid solution may be any metal, but is usually aluminum, niobium, or titanium. The gamma" phase is typically identified as $Ni_3(Nb, Ti, Al)$ and most commonly as $Ni_3Nb$. Another intermetallic compound, also used to precipitation strengthen superalloys, with the same stoichiometry but different crystal structure, is a gamma' phase that may be identified as $M_3Al$ (i.e., $Ni_3Al$, $Ti_3Al$, or $Fe_3Al$).

Figure 4A:
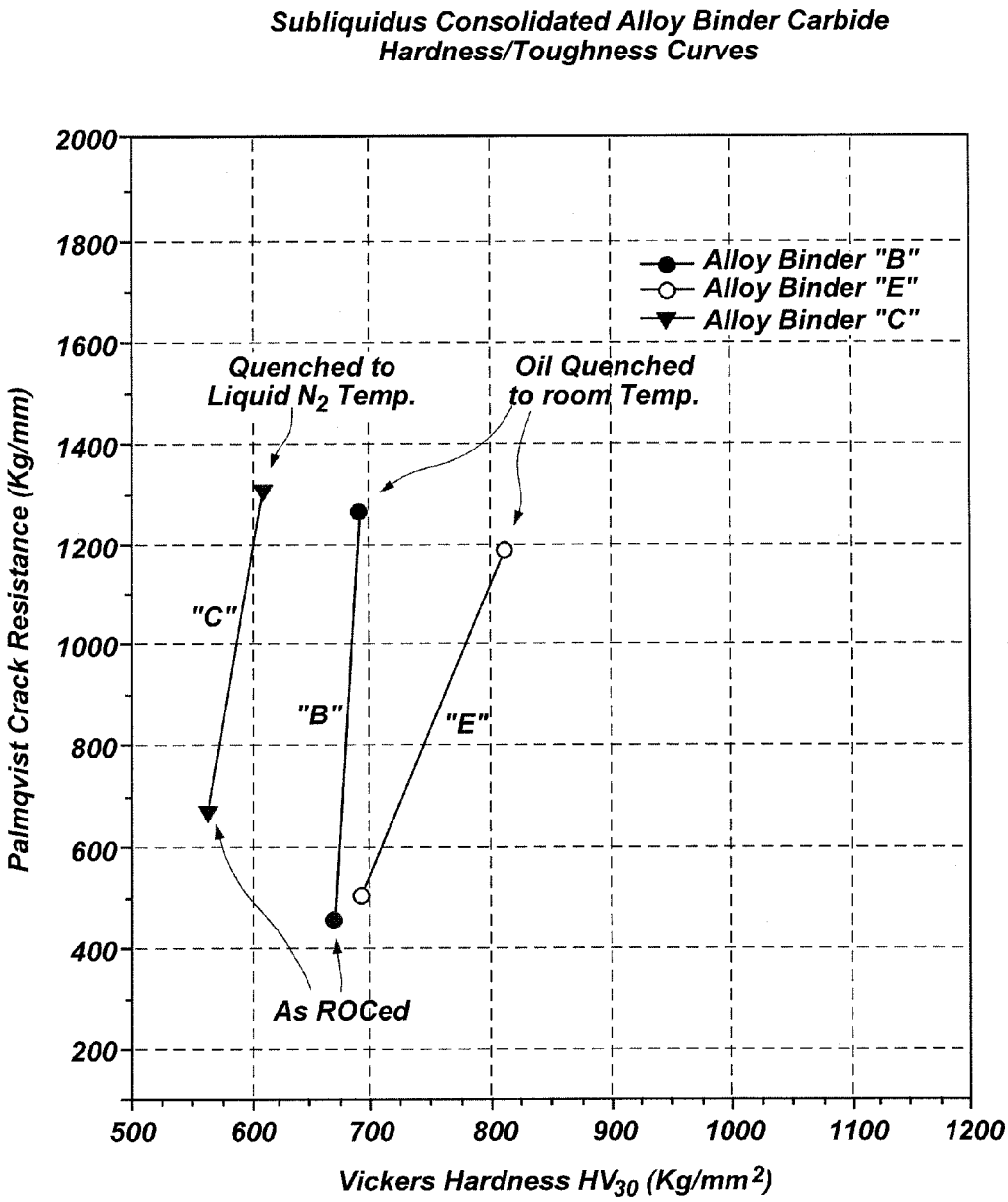
FIGS. 4A and 4B illustrate the effect of heat treatments on several exemplary tungsten carbide materials of the present invention manufactured by subliquidus consolidation.
Figure 4B:
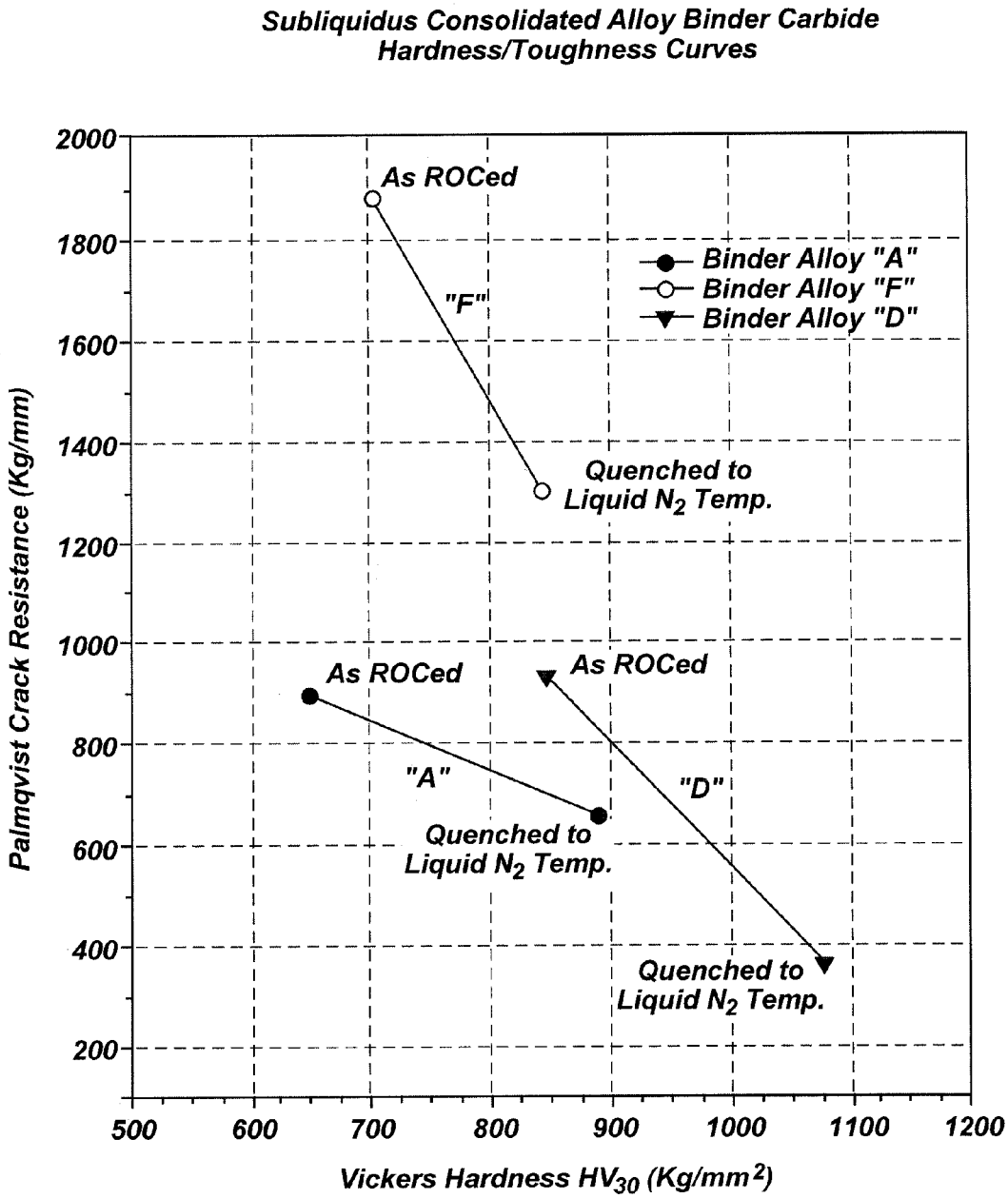

Referring to FIGS. 4A and 4B, the effect of heat treatments on the subliquidus consolidated tungsten carbide materials formulated with the exemplary alloy binder compositions is shown. FIG. 4A shows that alloy B, C, and E gain toughness with little change in hardness as a result of solution treatment followed by quenching. FIG. 4B shows that alloys A, D, and F undergo an increase in hardness accompanied by a drop in toughness as a result of solution treatment followed by quenching. As shown in FIGS. 4A and 4B, the material properties of subliquidus consolidated tungsten carbide materials of the present invention may be altered by heat treating, in contrast with conventional cobalt cemented tungsten carbide materials.

Figure 5:
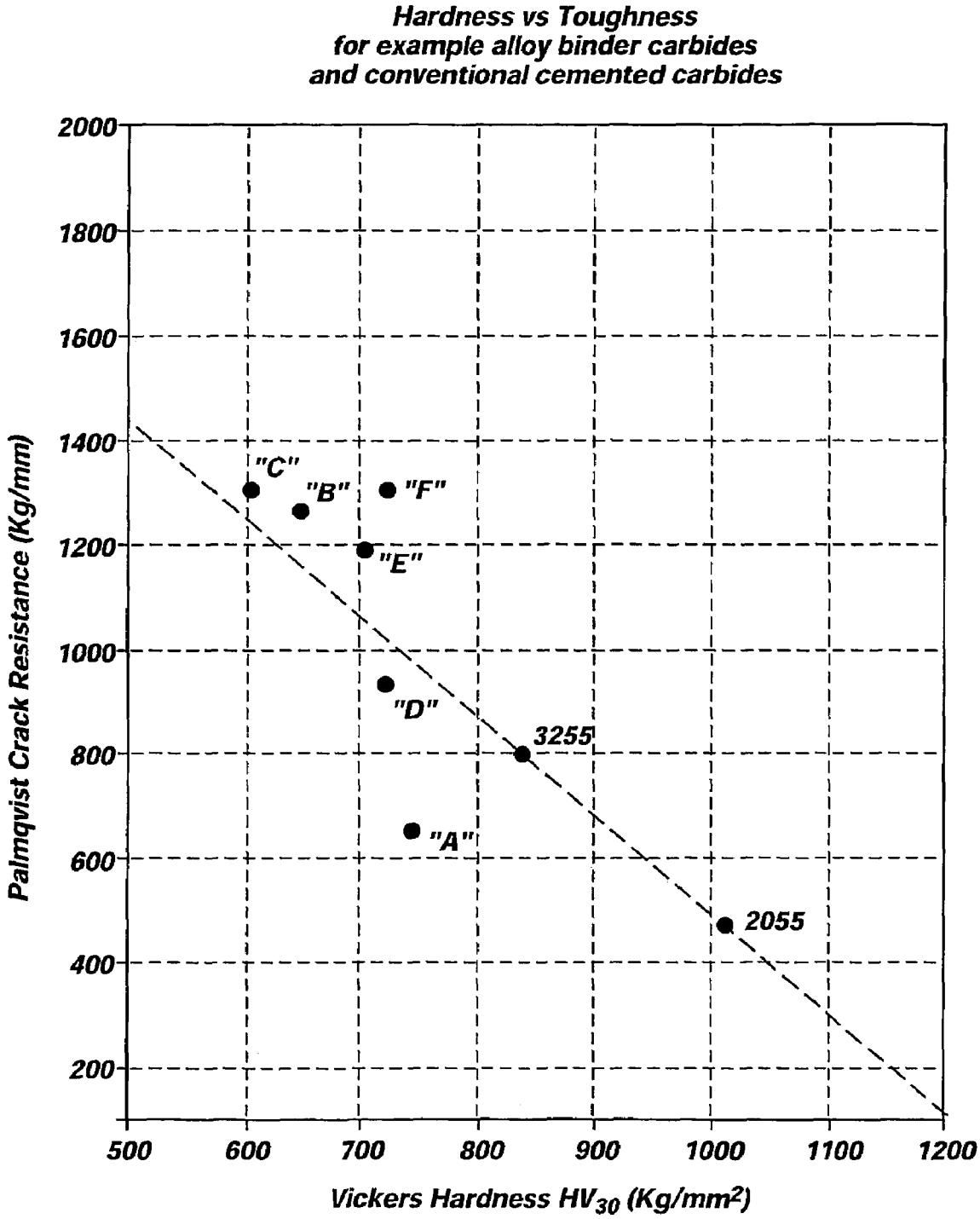
FIG. 5 is a graph of the Palmqvist crack resistance versus Vicker's hardness for several exemplary tungsten carbide materials of the present invention manufactured by subliquidus consolidation.
Figure 6A:
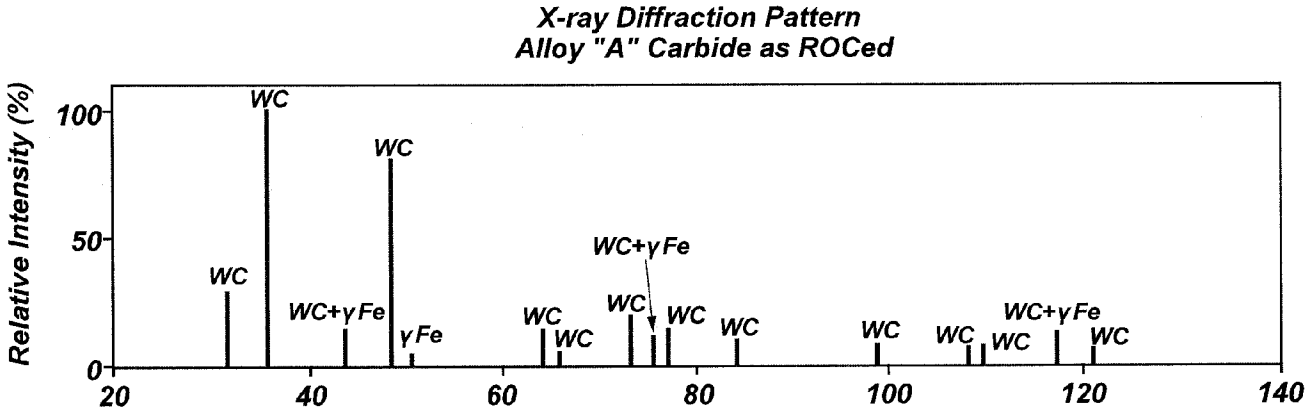
FIGS. 6A-6G are x-ray diffraction patterns for several example tungsten carbide materials of the present invention manufactured by subliquidus consolidation.
Figure 6B:
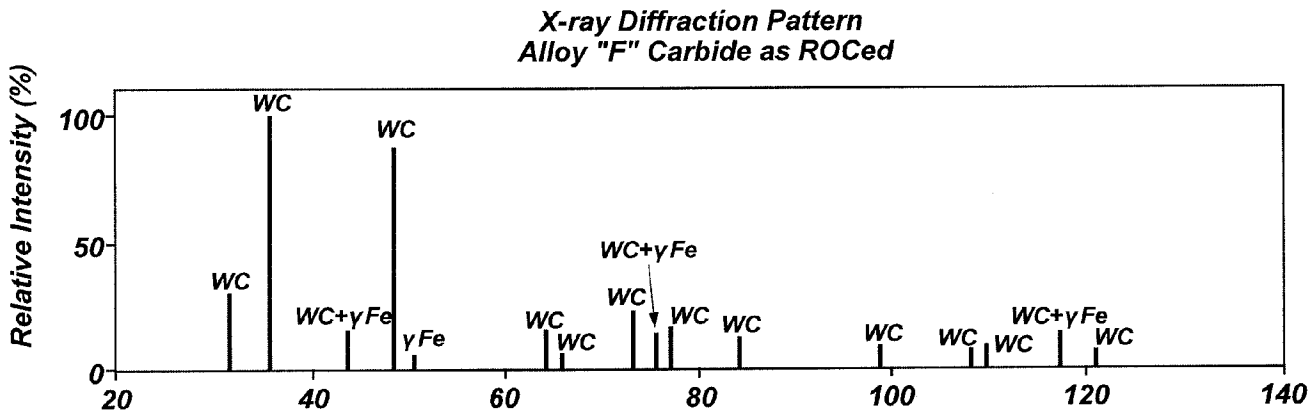
Figure 6C:
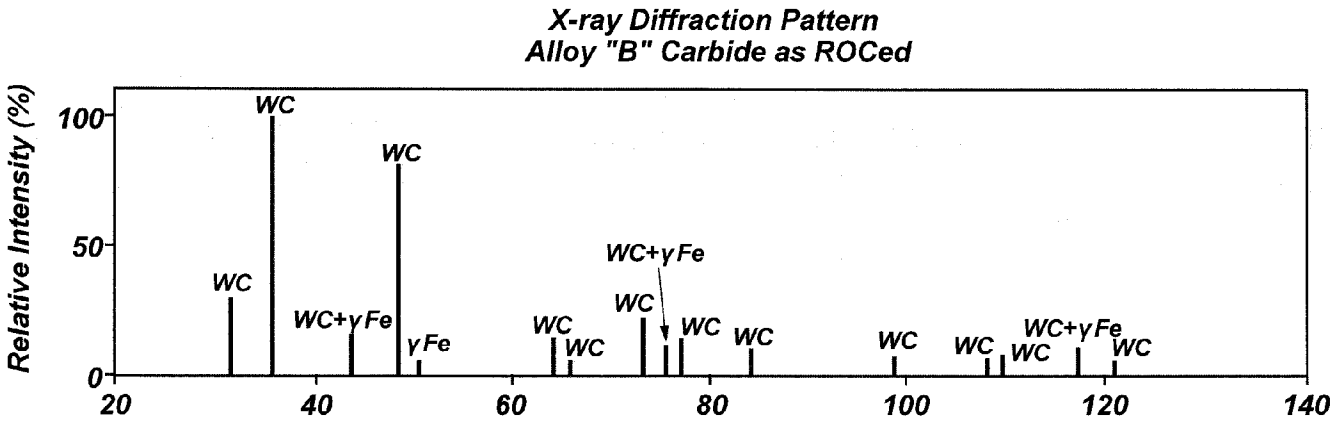
Figure 6D:
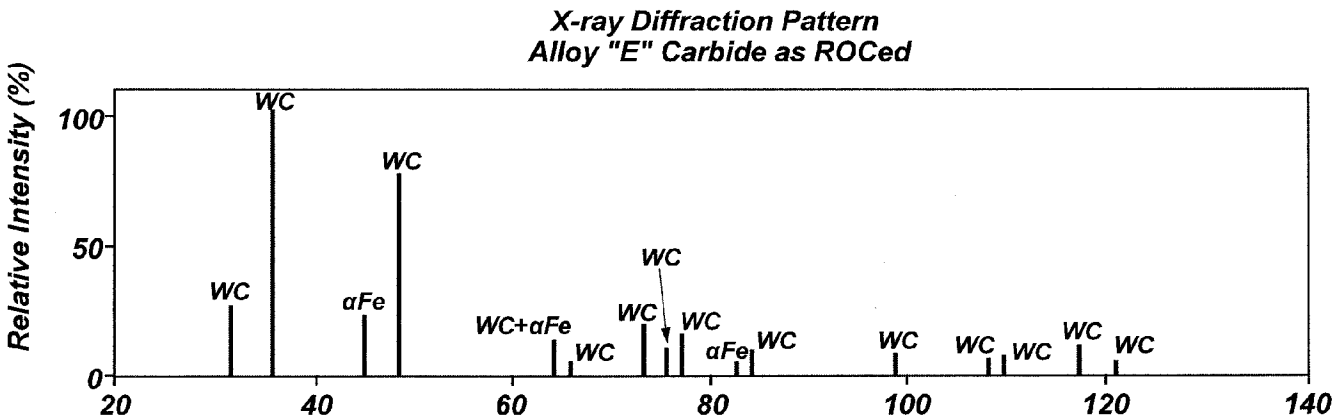
Figure 6E:
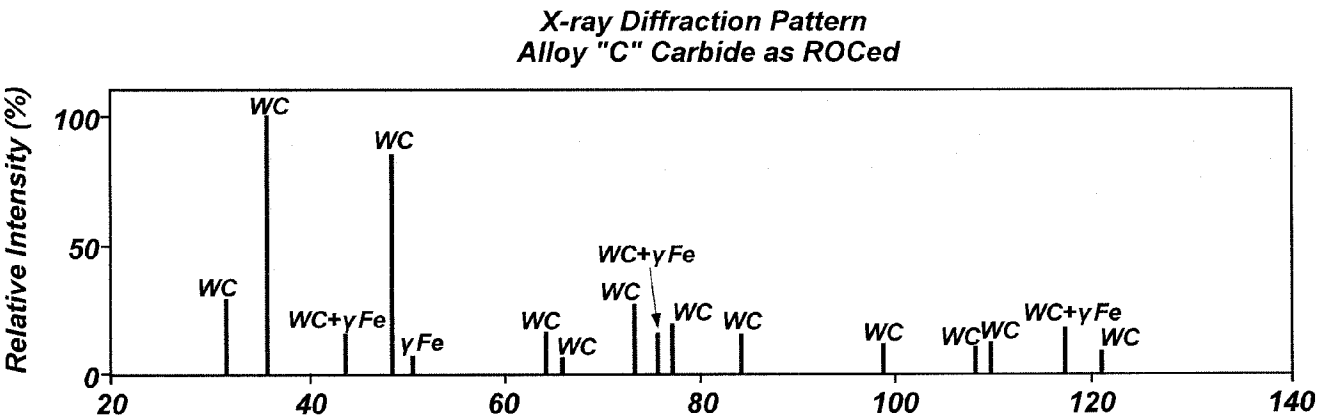
Figure 6F:
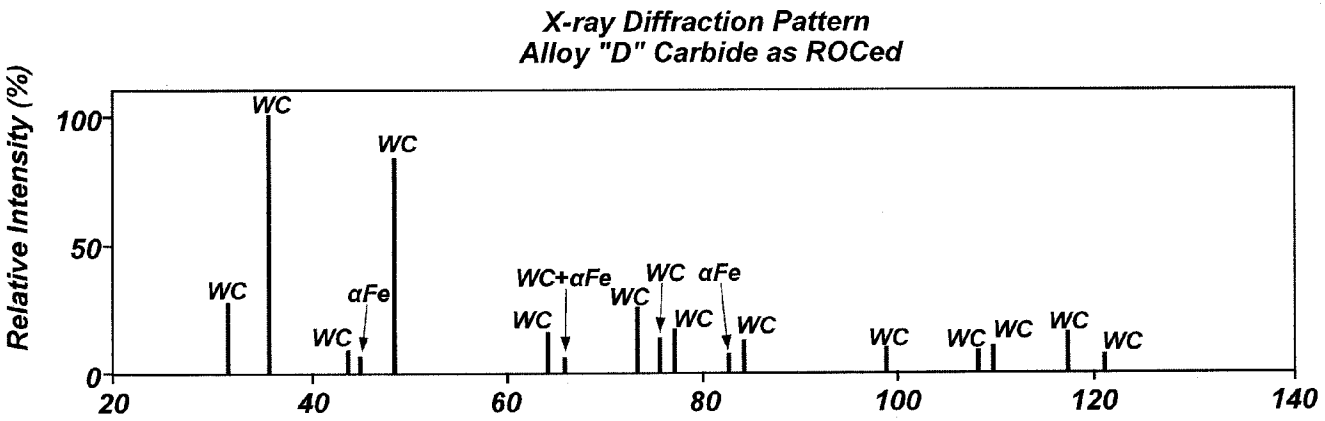
Figure 6G:
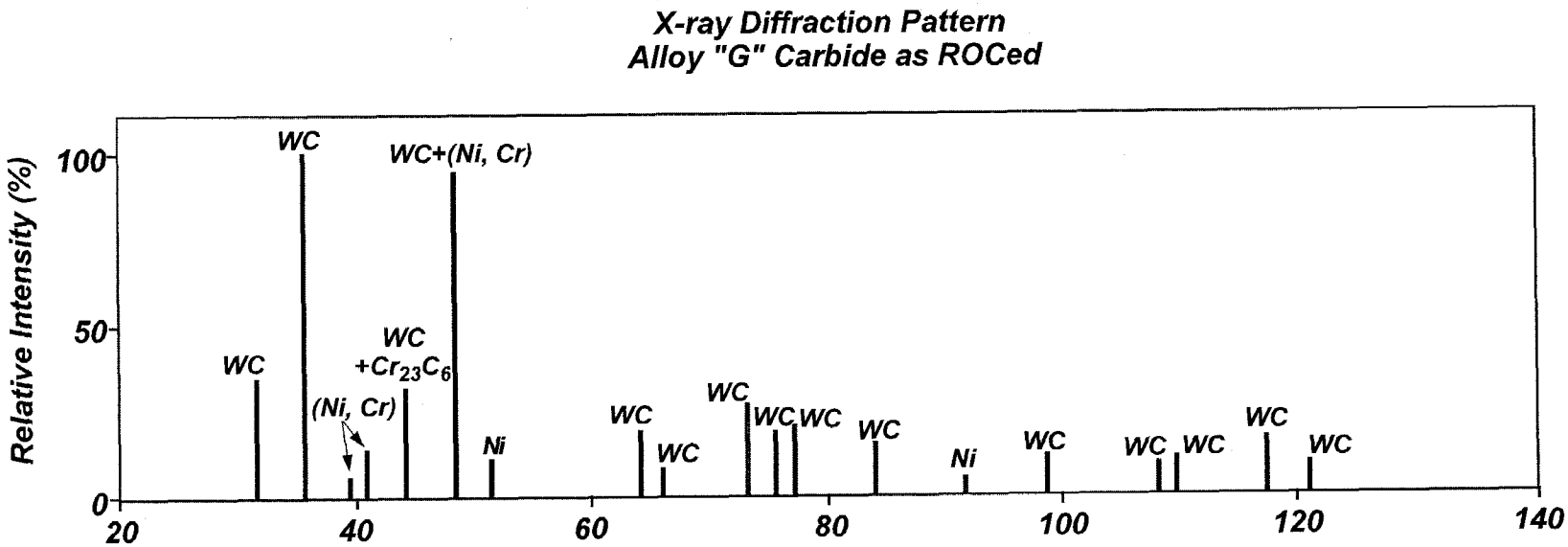

Referring to FIG. 5, Palmqvist crack resistance versus Vickers hardness of the heat treated subliquidus consolidated tungsten carbide materials of the above examples compared to two conventional carbide grades (3255 and 2055) is shown. Grades 3255 and 2055 are common, commercially available, 16% and 10% cobalt respectively, carbide grades widely used in petroleum drill bits. As shown by FIG. 5, subliquidus consolidated materials of the present invention may exhibit hardness/toughness combinations more desirable than conventional carbide materials.

Referring to FIGS. 6A-6G, X-ray diffraction patterns of the above example subliquidus consolidated tungsten carbide materials are shown. The X-ray diffraction patterns are dominated by tungsten carbide since it makes up 75 wt % of the materials. FIGS. 6A-6G demonstrate that neither double metal carbides phases nor graphite (free carbon) are present in the subliquidus consolidated materials of the above examples. FIGS. 6A-6G further demonstrate that the phases expected from the starting compositions of the binder materials are present even upon subliquidus consolidation with the tungsten carbide hard particles.

The above examples of subliquidus consolidated carbide materials should not be construed as limiting. Other compositions may be used that achieve some or all of the aforementioned desirable metallurgical and material properties. For instance, when Fe—Ni—C type alloys are used for binder material 22 and subliquidus consolidation is practiced in accordance with the present invention, FIG. 2B shows, in comparison to FIG. 2A depicting phase regions of (Fe+Ni)+WC resulting from liquid phase sintering, that a wide range of compositions may be selected while still avoiding the formation of undesirable brittle carbides (e.g., eta phase, $Fe_3W_3C$). Any and all such compositions for binder material 22 are fully embraced by the present invention.

Figure 7:
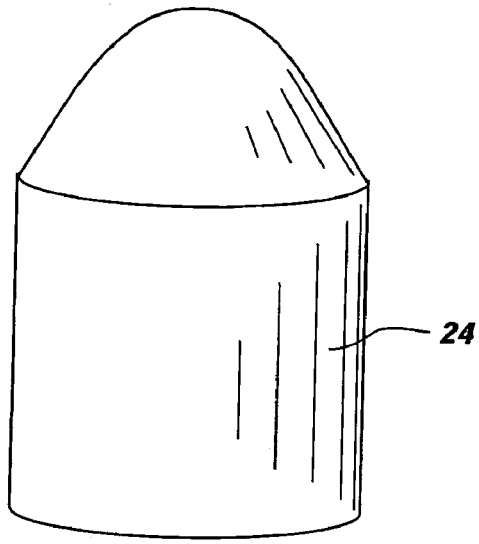
FIG. 7 is a schematic view of a consolidated hard material insert according to the present invention.
Figure 8:
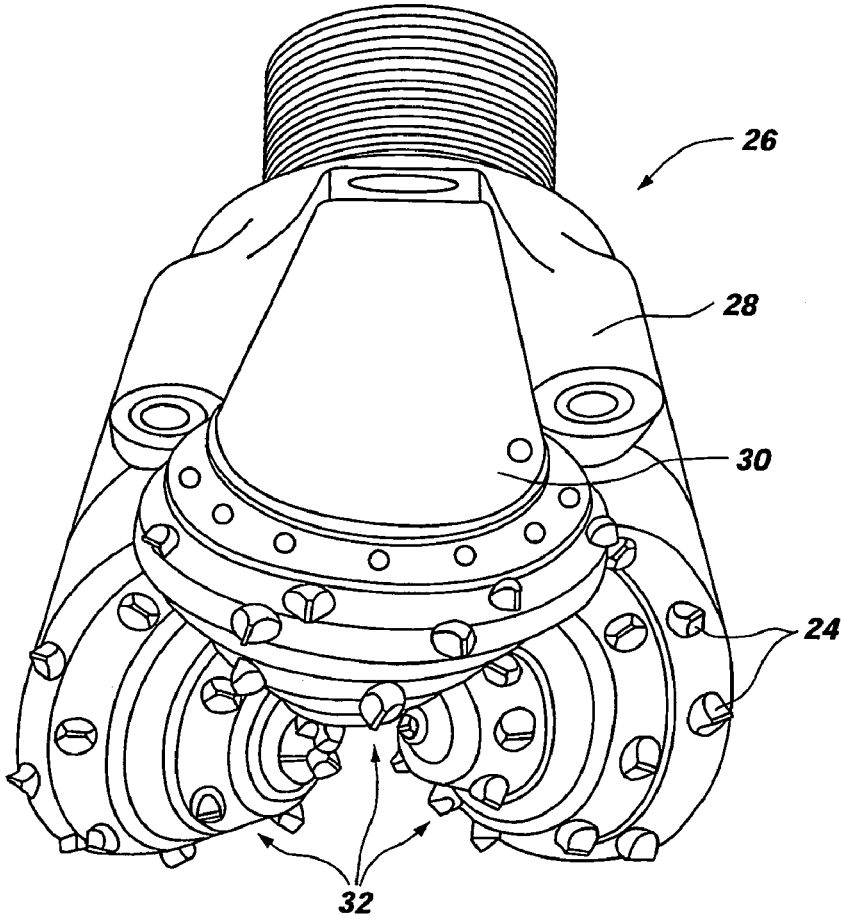
FIG. 8 is a perspective view of a roller cone drill bit comprising a number of inserts according to the present invention as depicted in FIG. 7.

The consolidated hard materials of this invention may be used for a variety of different applications, such as tools and tool components for oil and gas drilling, machining operations, and other industrial applications. The consolidated hard materials of this invention may be used to form a variety of wear and cutting components in such tools as roller cone or "rock" bits, percussion or hammer bits, drag bits, and a number of different cutting and machine tools. For example, referring to FIG. 7, consolidated hard materials of this invention may be used to form a mining or drill bit insert 24. Referring to FIG. 8, such an insert 24 may be used in a roller cone drill bit 26 comprising a body 28 having a plurality of legs 30, and a cone 32 mounted on a lower end of each leg 30. The inserts 24 are placed in apertures in the surfaces of the cones 32 for bearing on and crushing a formation being drilled.

Figure 9:
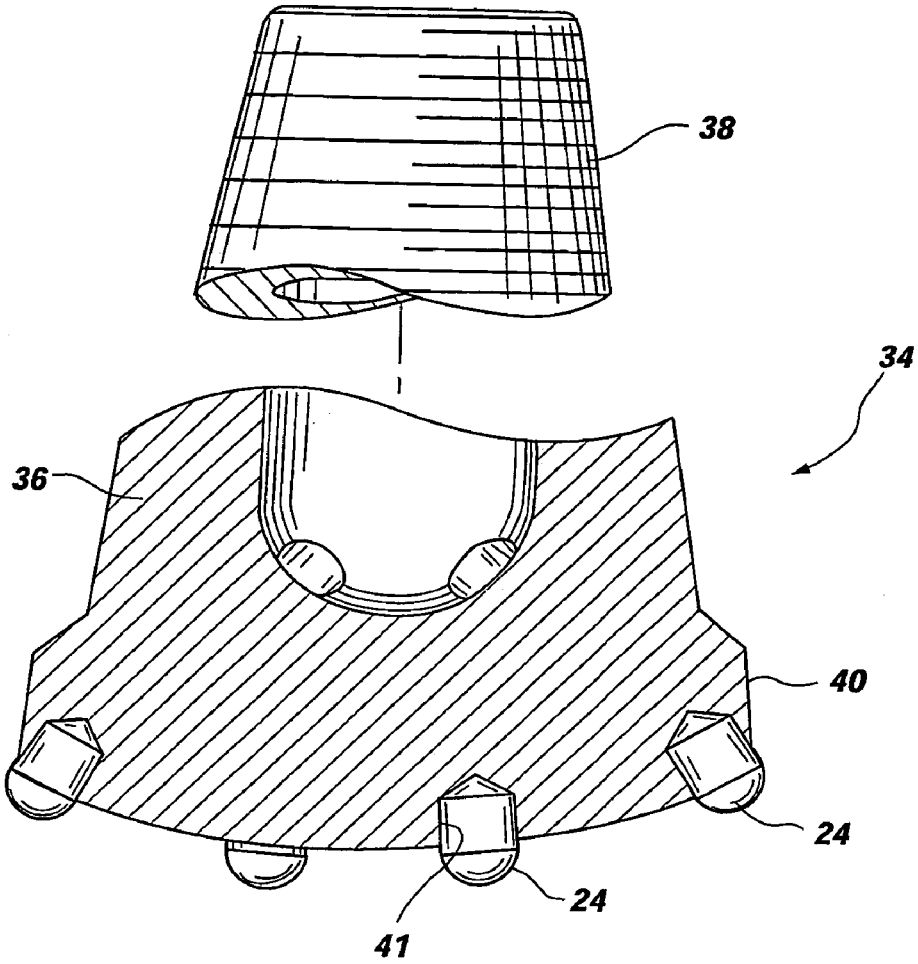
FIG. 9 is a perspective side view of a percussion or hammer bit comprising a number of inserts according to the present invention.

Referring to FIG. 9, inserts 24 formed from consolidated hard materials of this invention may also be used with a percussion or hammer bit 34, comprising a hollow steel body 36 having threaded pin 38 on an end of the body 36 for assembling the bit 34 onto a drill string (not shown) for drilling oil wells and the like. A plurality of the inserts 24 are provided in apertures 41 in the surface of a head 40 of the body 36 for bearing on the subterranean formation being drilled.

Figure 10:
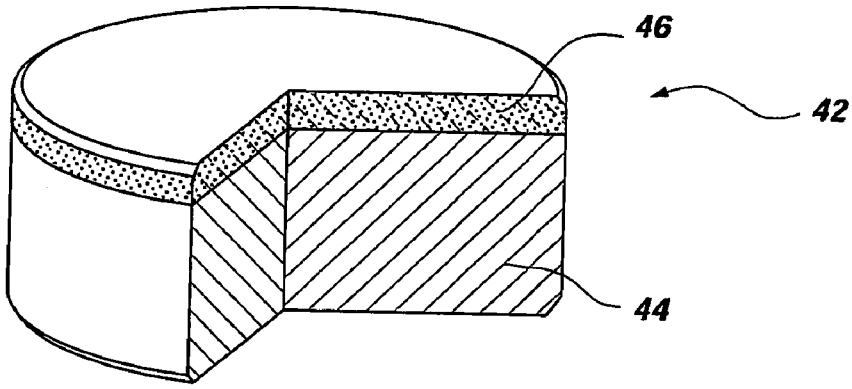
FIG. 10 is a perspective side view of a superabrasive shear cutter comprising a substrate formed from a consolidated hard material according to the present invention.
Figure 11:
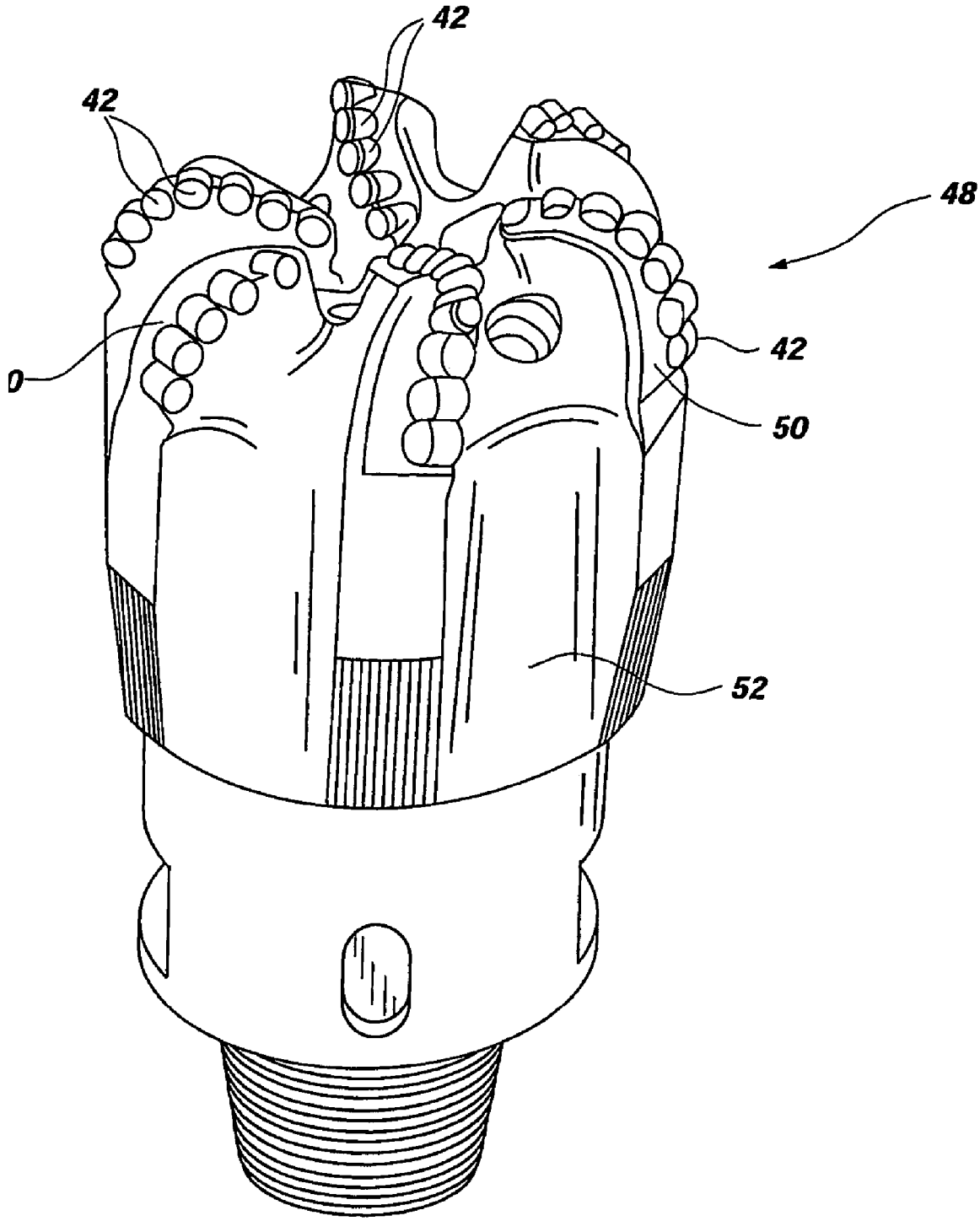
FIG. 11 is a perspective side view of a drag bit comprising a number of the superabrasive shear cutters configured as depicted in FIG. 10.

Referring to FIG. 10, consolidated hard materials of this invention may also be used to form superabrasive shear cutters in the form of, for example, polycrystalline diamond compact (PDC) shear-type cutters 42 that are used, for example, with a drag bit for drilling subterranean formations. More specifically, consolidated hard materials of the present invention may be used to form a shear cutter substrate 44 that is used to carry a layer or "table" of polycrystalline diamond 46 that is formed on it at ultrahigh temperatures and pressures, the techniques for same being well known to those of ordinary skill in the art. It should be noted that conventional substrates of cobalt binder tungsten carbide may employ "sweeping" of cobalt from the substrate as a catalyst for the formation of the diamond table. Using a substrate of the present invention, one would add cobalt in or adjacent to the particulate diamond before pressing to form the diamond table to provide the catalyst. Referring to FIG. 11, an illustrated drag bit 48 includes a plurality of such PDC cutters 42 that are each attached to blades 50 that extend from a body 52 of the drag bit 48 for cutting against the subterranean formation being drilled.

Figure 12A:
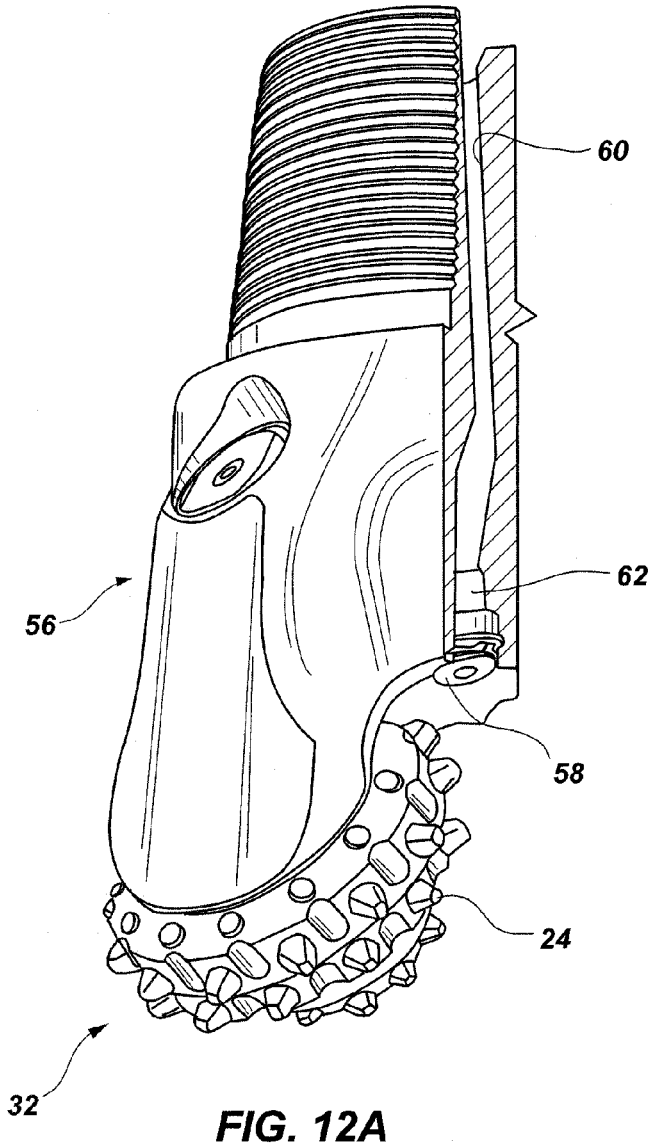
FIG. 12A is a perspective view of a drill bit carrying a nozzle formed at least in part from a consolidated hard material according to the present invention.
Figure 12B:
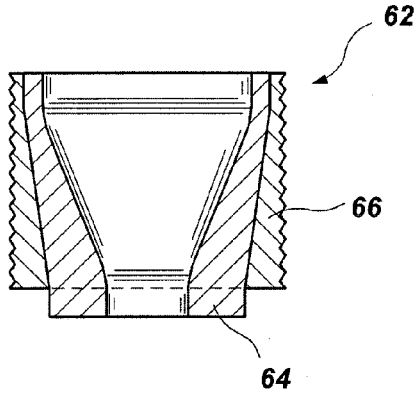
FIG. 12B is a sectional view of the nozzle depicted in FIG. 12A.

FIGS. 12A and 12B, respectively, illustrate a conventional roller cone drill bit 56 having a nozzle 62 and inserts 24 made from a consolidated hard material of the present invention and an enlarged cross-sectional view of a nozzle 62. Drill bit 56 has a central passage 60 therethrough and outlets 58 associated with each cone 32 (only one outlet shown). FIG. 12B shows nozzle 62 in more detail. The inner part of nozzle 62, or even the entire nozzle 62, comprises a nozzle insert 64 made from a consolidated hard material 66 of this invention.

Although the foregoing description of consolidated hard materials, production methods, and various applications of them contain many specifics, these should not be construed as limiting the scope of the present invention, but merely as providing illustrations of some exemplary embodiments. Similarly, other embodiments of the invention may be devised which do not depart from the spirit or scope of the present invention. The scope of the invention is, therefore, indicated and limited only by the appended claims and their legal equivalents, rather than by the foregoing description. All additions, deletions, and modifications to the invention, as disclosed herein, which fall within the meaning and scope of the claims are to be embraced.

What is claimed is:

1. A method for making a consolidated hard material comprising:

providing a binder including a material selected from the group consisting of iron-based alloys, nickel-based alloys, iron and nickel-based alloys, iron and cobalt-based alloys, aluminum-based alloys, copper-based alloys, magnesium-based alloys, and titanium-based alloys, commercially pure aluminum, commercially pure copper, commercially pure magnesium, commercially pure titanium, commercially pure iron and commercially pure nickel;

providing a plurality of hard particles selected from the group consisting of boron carbide, carbides of the group consisting of W, Ti, Mo, Nb, V, Hf, Ta, Zr, and Cr, and borides of the group consisting of W, Ti, Mo, Nb, V, Hf, Ta, Zr, and Cr;

selecting the binder and the hard particles to have closely matching coefficients of thermal expansion over a temperature range extending from about 0° C. to about 400° C.;

mixing a first quantity of the binder with a second quantity of the plurality of hard particles to form a mixture;

selecting the first quantity of the binder to cause the mixture to comprise between 5 weight percent and 39 weight percent binder;

selecting the second quantity of the plurality of hard particles to cause the mixture to comprise between 61 weight percent and 95 weight percent hard particles;

pressing the mixture of the binder and the plurality of hard particles into a pressed shape; and substantially simultaneously rapidly consolidating and sintering the pressed shape including the plurality of hard particles and the binder below a liquidus temperature of the binder to cause each hard particle of the plurality of hard particles to be cemented in, and in direct contact with, the binder.

2. The method of claim 1, wherein substantially simultaneously rapidly consolidating and sintering the pressed shape comprises substantially simultaneously rapidly consolidating and sintering the pressed shape below a liquidus temperature and above a solidus temperature of the binder.

3. The method of claim 1, wherein substantially simultaneously rapidly consolidating and sintering the pressed shape comprises substantially simultaneously rapidly consolidating and sintering the pressed shape below a solidus temperature of the binder.

4. The method of claim 1, wherein substantially simultaneously rapidly consolidating and sintering the pressed shape comprises surrounding the pressed shape with a pressure transmission medium and applying pressure to the pressed shape during sintering through the pressure transmission medium.

5. The method of claim 1, wherein substantially simultaneously rapidly consolidating and sintering the pressed shape comprises applying substantially isostatic pressure to the pressed shape.

6. The method of claim 1, further comprising heat treating the consolidated hard material.

7. The method of claim 1, further comprising precipitation hardening the consolidated hard material.

8. The method of claim 1, further comprising mechanically alloying the binder.

9. The method of claim 1, further comprising surface hardening the consolidated hard material.

10. The method of claim 9, further comprising surface hardening the consolidated hard material by a process selected from the group consisting of carburizing, carbonitriding, nitriding, induction heating, flame hardening, laser surface hardening, plasma surface hardening, ion implantation, tumbling, and shot peening.

11. The method of claim 1, wherein selecting the first quantity comprises selecting the first quantity of the binder to cause the mixture to comprise about 25 weight percent binder, and wherein selecting the second quantity comprises selecting the second quantity of the plurality of hard particles to cause the mixture to comprise about 75 weight percent hard particles.

12. The method of claim 1, further comprising formulating the binder with about 68 to 80 weight percent iron, about 19 to 32 weight percent nickel, and about 0 to 1.0 weight percent carbon.

13. The method of claim 1, further comprising formulating the binder with a composition of about 88 to 99 weight percent iron, about 0 to 10 weight percent nickel, and about 0 to 3.0 weight percent carbon.

14. The method of claim 1, further comprising formulating the binder with a composition of about 60.5 weight percent nickel, about 20.5 weight percent chromium, about 9.0 weight percent molybdenum, about 5.0 weight percent niobium, and about 5.0 weight percent iron.

15. The method of claim 1, further comprising formulating the binder with a Hadfield austenitic manganese steel.

16. The method of claim 1, further comprising at least partially coating the hard particles with the binder during the forming the mixture.

17. The method of claim 16, further comprising forming the mixture and at least partially coating the hard particles with the binder in an attritor mill or a ball mill.

18. The method of claim 1, further comprising forming the binder by mechanical alloying.

19. The method of claim 18, further comprising effecting the mechanical alloying in an attritor mill.

20. The method of claim 19, further comprising at least partially coating the hard particles with the binder during the forming the mixture.

21. The method of claim 20, further comprising forming the mixture and at least partially coating the hard particles with the binder in an attritor mill or a ball mill.

22. The method of claim 20, wherein the binder is mechanically alloyed and the mixture of the binder and the hard particles is formed in the same attritor mill.

23. A consolidated hard material, comprising:

a plurality of hard particles selected from the group consisting of boron carbide, carbides of the group consisting of W, Ti, Mo, Nb, V, Hf, Ta, Zr, and Cr, and borides of the group consisting of W, Ti, Mo, Nb, V, Hf, Ta, Zr, and Cr, each hard particle of the plurality of hard particles cemented in, and in direct physical contact with, a sub-liquidus transformed binder selected from the group consisting of iron-based alloys, nickel-based alloys, iron and nickel-based alloys, iron and cobalt-based alloys, aluminum-based alloys, copper-based alloys, magnesium-based alloys, and titanium-based alloys, commercially pure aluminum, commercially pure copper, commercially pure magnesium, commercially pure titanium, commercially pure iron and commercially pure nickel, the plurality of hard particles comprising between about 61 and 95 weight percent of the consolidated hard material, the binder comprising between about 5 and about 39 weight percent of the consolidated hard material; wherein the plurality of hard particles and the binder exhibit closely matching coefficients of thermal expansion over a temperature range extending from about 0° C. to about 400° C.

24. A consolidated material comprising:

a plurality of hard particles each cemented in, and in direct contact with, a post consolidation thermally treated non-cobalt binder, the plurality of hard particles selected from the group consisting of boron carbide, carbides of the group consisting of W, Ti, Mo, Nb, V, Hf, Ta, Zr, and Cr, and borides of the group consisting of W, Ti, Mo, Nb, V, Hf, Ta, Zr and Cr, the consolidated material exhibiting a Vickers Hardness ($HV_{30}$, $kg/mm^2$) of about 600 to about 750 and a Palmqvist Crack Resistance (kg/mm) of about 600 to about 1400.

25. The consolidated material of claim 24, wherein the binder comprises about 3 to 50 weight percent and the plurality of hard particles comprises about 50 to 97 weight percent of the total weight of the consolidated material.

26. The consolidated material of claim 24, wherein the binder comprises about 68 to 80 weight percent iron, about 19 to 32 weight percent nickel, and about 0 to 1.0 weight percent carbon.

27. The consolidated material of claim 24, wherein the binder comprises about 88 to 99 weight percent iron, about 0 to 10 weight percent nickel, and about 0 to 3.0 weight percent carbon.

28. The consolidated material of claim 24, wherein the binder comprises about 60.5 weight percent nickel, about 20.5 weight percent chromium, about 9.0 weight percent molybdenum, about 5.0 weight percent niobium, and about 5.0 weight percent iron.

29. The consolidated material of claim 24, wherein the binder comprises a Hadfield austenitic manganese steel.

30. The consolidated material of claim 24, wherein the consolidated material is substantially free of double metal carbides.

31. A consolidated hard material mass, comprising:

a plurality of hard particles selected from the group consisting of boron carbide, carbides of the group consisting of W, Ti, Mo, Nb, V, Hf, Ta, Zr, and Cr, and borides of the group consisting of W, Ti, Mo, Nb, V, Hf, Ta, Zr, and Cr, the plurality of hard particles comprising between about 61 and 95 weight percent of a consolidated hard material mass;

and a binder including a material selected from the group consisting of iron-based alloys, nickel-based alloys, iron and nickel-based alloys, iron and cobalt-based alloys, aluminum-based alloys, copper-based alloys, magnesium-based alloys, titanium-based alloys, commercially pure aluminum, commercially pure copper, commercially pure magnesium, commercially pure titanium, commercially pure iron and commercially pure nickel, the binder cemented with the plurality of hard particles, the binder comprising between about 5 and about 39 weight percent of the consolidated hard material mass, wherein the binder and the plurality of hard particles each exhibits a coefficient of thermal expansion less than about $4.5 \times 10^{-6}$° C.$^{-1}$ over a temperature range extending from about 0° C. to about 250° C.

32. A drill bit comprising:

a body having a structure adapted to engage a subterranean formation during drilling; and a plurality of inserts carried on the structure, the inserts formed from a consolidated hard material comprising:

a plurality of hard particles selected from the group consisting of boron carbide, carbides of the group consisting of W, Ti, Mo, Nb, V, Hf, Ta, Zr, and Cr, and borides of the group consisting of W, Ti, Mo, Nb, V, Hf, Ta, Zr, and Cr; and a binder at least partially surrounding and in direct physical contact with each hard particle of the plurality of hard particles, the binder including a material selected from the group consisting of iron-based alloys, nickel-based alloys, iron and nickel-based alloys, iron and cobalt-based alloys, aluminum-based alloys, copper-based alloys, magnesium-based alloys, and titanium-based alloys, commercially pure aluminum, commercially pure copper, commercially pure magnesium, commercially pure titanium, commercially pure iron and commercially pure nickel, the binder cemented with the plurality of hard particles and comprising about 25 weight percent or less of the consolidated hard material;

wherein the plurality of hard particles and the binder exhibit closely matching coefficients of thermal expansion over a temperature range extending from about 0° C. to about 400° C.

33. A superabrasive cutter, comprising:

a substrate formed from a consolidated hard material comprising:

a plurality of hard particles selected from the group consisting of boron carbide, carbides of the group consisting of W, Ti, Mo, Nb, V, Hf, Ta, Zr, and Cr, and borides of the group consisting of W, Ti, Mo, Nb, V, Hf, Ta, Zr, and Cr; and a binder including a material selected from the group consisting of iron-based alloys, nickel-based alloys, iron and nickel-based alloys, iron and cobalt-based alloys, aluminum-based alloys, copper-based alloys, magnesium-based alloys, and titanium-based alloys, commercially pure aluminum, commercially pure copper, commercially pure magnesium, commercially pure titanium, commercially pure iron, and commercially pure nickel, the binder cemented with the plurality of hard particles and comprising between about 25 weight percent or less of the consolidated hard material;

wherein the consolidated hard material exhibits a coefficient of thermal expansion less than about $4.5 \times 10^{-6}$° C.$^{-1}$over a temperature range extending from about 0° C. to about 250° C.; and a layer of superabrasive material disposed on a surface of the substrate.

34. A drill bit comprising:

a body having a head with a surface adapted to engage a subterranean formation during drilling;

an internal passage with at least one outlet for the passage of drilling fluid therethrough; and a nozzle disposed in the at least one outlet, the nozzle including a consolidated hard material comprising:

a plurality of hard particles selected from the group consisting of boron carbide, carbides of the group consisting of W, Ti, Mo, Nb, V, Hf, Ta, Zr, and Cr, and borides of the group consisting of W, Ti, Mo, Nb, V, Hf, Ta, Zr, and Cr; and a binder including a material selected from the group consisting of iron-based alloys, nickel-based alloys, iron and nickel-based alloys, iron and cobalt-based alloys, aluminum-based alloys, copper-based alloys, magnesium-based alloys, and titanium-based alloys, commercially pure aluminum, commercially pure copper, commercially pure magnesium, commercially pure titanium, commercially pure iron and commercially pure nickel, the binder cemented with the plurality of hard particles and comprising about 25 weight percent or less of the consolidated hard material;

wherein the consolidated hard material exhibits a coefficient of thermal expansion less than about $4.5 \times 10^{-6}$° C.$^{-1}$ over a temperature range extending from about 0° C. to about 250° C.

35. The method of claim 1, further comprising selecting the binder and the hard particles to each have a coefficient of thermal expansion less than about $4.5 \times 10^{-6}$° C.$^{-1}$ over a temperature range extending from about 0° C. to about 250° C.

* * * * *

UNITED STATES PATENT AND TRADEMARK OFFICE

CERTIFICATE OF CORRECTION

PATENT NO. : 7,556,668 B2
APPLICATION NO. : 10/496246
DATED : July 7, 2009
INVENTOR(S) : Jimmy W. Eason, James C. Westhoff and Roy Carl Lueth It is certified that error appears in the above-identified patent and that said Letters Patent is hereby corrected as shown below:

On the title page:

In ITEM (57) ABSTRACT

15th line, change "hot ecstatic" to --hot isostatic--

In the drawings:

In FIG. 11 change the reference numeral "0" to --50-- appearing on the left-hand side of the figure

Replace FIG. 11 with the following amended figure:

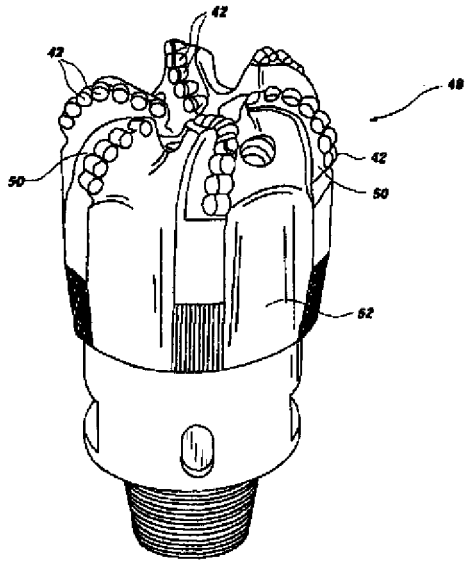

*FIG. 11*

Signed and Sealed this
Seventh Day of June, 2011

David J. Kappos

David J. Kappos
*Director of the United States Patent and Trademark Office*